US005695280A

United States Patent [19]

Baker et al.

[11] Patent Number: 5,695,280

[45] Date of Patent: Dec. 9, 1997

[54] CONCRETE STABILIZATION SYSTEM AND METHOD FOR UTILIZING SAME

[75] Inventors: Darrell J. Baker, Crestwood; James M. Clarke, Peotone; Martin Ozinga, III, Lockport; Richard D. DeBoer, Oak Lawn, all of Ill.

[73] Assignee: Ozinga Bros., Inc., Orland Park, Ill.

[21] Appl. No.: 508,616

[22] Filed: Jul. 28, 1995

[51] Int. Cl.[6] ..... B28C 7/00

[52] U.S. Cl. ..... 366/17; 366/27; 366/36; 366/41

[58] Field of Search ..... 366/1, 2, 6, 14, 366/15, 16, 17, 36, 39, 53, 54, 60, 63, 220, 27, 41, 44

[56] References Cited

U.S. PATENT DOCUMENTS

| | | | |
|---|---|---|---|
| 2,942,731 | 6/1960 | Soldini . | |
| 3,278,022 | 10/1966 | Moeschler . | |
| 3,596,759 | 8/1971 | King et al. . | |
| 3,695,427 | 10/1972 | Friesz . | |
| 3,997,434 | 12/1976 | Macauley, Jr. . | |
| 3,998,437 | 12/1976 | Kitsuda et al. | 366/17 |
| 4,097,925 | 6/1978 | Butler, Jr. | 366/2 |
| 4,210,456 | 7/1980 | Miller . | |
| 4,226,542 | 10/1980 | Black et al. | 366/17 |
| 4,432,801 | 2/1984 | Tegiacchi et al. . | |
| 4,488,815 | 12/1984 | Black . | |
| 4,786,179 | 11/1988 | Kaminski . | |
| 4,964,917 | 10/1990 | Bobrowski et al. . | |
| 5,127,740 | 7/1992 | DeBoer . | |
| 5,178,455 | 1/1993 | Ohsaki et al. | 366/14 X |
| 5,221,343 | 6/1993 | Grauer et al. . | |
| 5,244,498 | 9/1993 | Steinke . | |

*Primary Examiner*—Charles E. Cooley
*Attorney, Agent, or Firm*—Dorn, McEachran, Jambor & Keating; Vangelis Economou

[57] ABSTRACT

A concrete stabilization system which includes a number of subsystems to provide a complete reuse and reclaiming of all concrete which remains unused at the end of the production day, and also reclaims all constituents of washout concrete from a number of concrete mixer trucks following the washing out process. A tower is provided for vertical and tilting motion of a material handling bucket, and a stationary mixer for stabilizing concrete and constituent material for reuse with fresh concrete batches at the start of the next production day or up to four days later. The fully automated system includes a start sequence initiated by the operator of the truck, and the process is then fully automated by a process controller which may be monitored off-site. The method includes a number of loop cycles, such as truck discharge and washout cycles, a stationary mixer load cycle, a water scan cycle which determines if the reused wash water contains excessive solid constituents, which are stored in the stationary mixer at intervals, so that the slurry water can continue reuse as wash water. The stabilization loop continually and automatically monitors the hydration state of the concrete in the stationary mixer and a chemical additive for retarding the hydration of the concrete is added to maintain the fluidity and plasticity of the concrete. The concrete is always ready for use because the chemical additive, a sugar based derivative, only retards the setting of the concrete for a short period.

13 Claims, 15 Drawing Sheets

CONCRETE STABILIZATION SYSTEM AND METHOD FOR UTILIZING SAME

BACKGROUND OF THE INVENTION

1. Field of the Invention

This invention generally relates to the field of concrete reclamation, and more particularly to methods and systems for storing, stabilizing and recycling concrete and other materials so as to avoid unnecessary waste and pollution.

2. Background Art

Primarily due to environmental concerns, concrete reclamation is fast becoming a standard in the concrete production and construction industries. The advantages of reclaiming and reusing unneeded or unpoured concrete at the end of the concrete pouring cycle are clear from both an economic and an environmental position.

Proposals for concrete reclamation have been made by the concrete production and delivery industry. U.S. Pat. Nos. 2,942,731, 3,278,022, 3,596,759, 3,695,427, 3,997,434, and 4,488,815 each describe methods for addressing the environmental concerns and various prior attempts by the industry to solve them. Methods for reclaiming small quantities of concrete which remain in a "ready-mix" truck after the concrete in the truck has been discharged have been proposed. A pressing concern, as described in these patents, is the reclamation of slurry water which contains small amounts of dissolved concrete. Slurry water results when a truck, mixer or other concrete container has been flushed with water to clean out the truck mixing chamber. The majority of the industry attempts to solve these concerns address the methods of separation of the cement slurry into its water, sand and gravel constituents. Years of effort by the industry have yet to define a workable solution to the problem of how to reuse the constituent products. Similar problems exist for other separation systems that receive substantial amounts of unused ready-mixed concrete which separate it into its constituent products.

Another concern is that of substantial quantities of concrete which remain unused at a building site because the concrete pour is completed without necessitating use of all of the concrete contained in the ready-mix truck. The leftover amounts may vary depending on the accuracy of the projections made as to how much concrete is needed at a job site. Because the concrete is first mixed at a mixing plant and then transported by a ready-mix truck to a job site, the projected need for concrete will usually exceed the amount which is actually used. Overestimating concrete usage may avoid extra truck trips and lost driver time. The result of overestimation of the amount of concrete needed is that frequently the ready-mix truck returns at the end of the day with some portion of the unpoured concrete still in the ready-mix truck. Thus, there is a need in the industry for a method of and system for reclaiming the unused portion of the concrete for future use, and to do so efficiently to avoid an excessive amount of downtime on the part of the ready-mix trucks.

Concrete which is stored for use during the next day's concrete pour is susceptible to hydration and setting. Concrete which has set beyond a specified slump value cannot be re-used because pouring becomes difficult or impossible. U.S. Pat. No. 4,786,179 describes a fluid induction system which is attached to the inside of a ready-mix truck barrel to maintain the moist condition of a ready-mix concrete truck which is disabled in the field, but does not adequately address the problems relating to reclaiming unused portions of concrete. Also, the method described cannot be used for concrete storage for long periods without affecting the strength and quality of the stored concrete.

Various methods for retarding hydration of concrete have been proposed in the prior art, one of which is disclosed by U.S. Pat. No. 4,964,917. That patent is directed to a method of retarding concrete and chemical composition for retarding hydration of concrete and for reversal of the process, acceleration of concrete hydration, when the concrete is again desired for pouring.

Other methods of retarding the setting of concrete are independent of the addition of an accelerant to the hydration retarded concrete. Examples of such hydration retardant process are described in U.S. Pat. Nos. 5,244,498, 5,221,343, 4,432,801 and 4,210,456. However, none of these described methods provide a solution to the problem of bulk material handling at the ready-mix plant, especially during times of high return volume of unpoured and unused concrete, such as at the end of the day, when several trucks may be waiting to discharge excess concrete from their respective mixers. Also none teach a fully automated system or method. Without an efficient and automated material handling system, the ready-mix plant workers are left with the task of calculating the dose of retardant to be added to the concrete in each truck and, optionally, with calculating the dosage of accelerant to be added the next day.

One of the inventors of the present invention has addressed to some degree the material handling problem discussed above. U.S. Pat. No. 5,127,740, assigned to a common assignee as that of the present invention, provides a concrete reclamation system and method of utilization which takes into account the requirements of reclaiming or re-using substantial portions of concrete returned from job sites. The method requires the addition of additives to the unused portions of concrete both at the time it is placed into storage and at the time that it is "reactivated" for use. The system described in U.S. Pat. No. 5,127,740 works well for those who have a very good working knowledge of the conditions of concrete, of the ambient atmosphere, etc. and who also have a good set of tables to permit them to calculate the amount of concrete additive necessary to maintain the dehydrated state of a concrete batch.

However, for those users who may not wish to become expert in concrete management, or who cannot continually and manually monitor the condition of a batch of concrete, an automatic system is necessary. Moreover, once the concrete is induced with chemical, as described in U.S. Pat. No. 5,127,740, it is difficult, if not impossible, to reset or change the conditions of the concrete to account for a change in condition of the atmosphere or for inadvertent miscalculations in the amount of retardant added to a concrete batch.

None of the methods taught heretofore provide for monitoring the status of the concrete overnight or for a longer period of time. No matter how good a table is researched and implemented, manually calculated methods are susceptible to human error in dosing the concrete, and also to unanticipated environmental conditions, such as an unexpected temperature or humidity change, both of which could lead to concrete setting and becoming hard in the storage container because the dosage of the chemical retardant may have been calculated for different conditions.

What is needed is a system that has the capability to cleanly, quickly and efficiently handle all unused portions of concrete material, to maintain the leftover concrete material in a viable state over extended periods of time, possibly up to four days, by retarding it with an appropriate chemical, to continually reuse the washwater used to rinse an "empty"

drum of a ready-mix truck, and to have the capability of discharging the stabilized concrete for shipment at any time in the stabilization cycle without further treatment, such as the addition of an accelerating agent.

SUMMARY OF THE INVENTION

Accordingly, there is provided an automatic system to reclaim for reuse unused portions of mixed concrete comprising unloading means for discharging the unused portions of concrete from a movable container, a material handling bucket for receiving the unused portions of concrete from the unloading means, means for elevating and lowering the material handling bucket, the means including automatic controls for activating the elevation and lowering means, means for automatically tilting the material handling bucket and for pouring the concrete contained by the material handling bucket to a desired location, a storage mixer, a temporary settling container, or a similar storage vessel, the means including automatic controls for activating the means for automatically tilting the material handling bucket, means for automatically adding a chemical agent to the unused concrete to change the hydration condition of the concrete, the means including automatic controls for activating the means to add the chemical agent to the concrete, at least one storage mixer for receiving the unused concrete from the material handling bucket and for storing the unused concrete, the mixer being capable of revolving, means for revolving the mixer and causing the chemical agent to homogeneously mix with the concrete in the storage mixer, including automatic controls for activating the storage mixer to rotate and mix the concrete in the storage mixer at preselected periods or when predetermined parameters of the concrete conditions have been met, means for discharging the concrete from the storage mixer into the material handling bucket and for loading the concrete into a desired receptacle, a plurality of sensors for monitoring the condition of the concrete in the storage means and in the ambient environment to determine whether the predetermined parameters are met and means for communication between the sensors and the process controller and between the process controller and the automatic controls to provide signal data to the process controller for monitoring the condition of the concrete and for supplying signal data to the automatic controls to activate the appropriate elements of the system to change the condition of the concrete and to bring the condition within said predetermined parameters. Additionally, the system provides for a means of responding to said monitoring by appropriately inducing a chemical agent or other hydration retarding material as needed to maintain the concrete in a viable condition.

Also disclosed is a method for washing out a mixer truck of left over portions of concrete comprising the steps of discharging the unused portions of concrete from the mixer truck into a storage container, adding a predetermined amount of a chemical agent to a carrier, said chemical agent being capable of changing the hydration state of concrete, utilizing the carrier and chemical agent to wash out the barrel of the mixer truck, discharging the carrier from the mixer truck barrel into a material handling bucket, and allowing the carrier to settle for a predetermined amount of time so that solid constituents entrained in the carrier settle to the bottom of the material handling bucket, automatically tilting the material handling bucket and thereby discharging the carrier and chemical agent, which has risen above the settled constituent solids, into at least one temporary storage container, and reusing the carrier by repeating the above steps to wash out a second mixer truck, then using said solid constituents in the process of stabilizing the concrete.

Also disclosed is an automated method for reclaiming unused portions of mixed concrete for reuse, the method comprising the steps of discharging unused portions of concrete from a movable container into a material handling bucket, automatically weighing the concrete in the material handling bucket by an automatic weighing means, automatically tilting the material handling bucket and pouring the concrete contained in the material handling bucket to a temporary storage container, adding a chemical agent to the concrete to change the hydration state of the concrete, receiving the unused concrete from the temporary storage container in at least one storage mixer and temporarily storing the concrete therein, the mixer being capable of revolving, revolving the mixer and causing the chemical agent to homogeneously mix with the concrete in the storage mixer, intermittently automatically monitoring the slump of the concrete contained in the mixer by a process control means, and adding a chemical agent to the concrete in the mixer to change the hydration state of the concrete in response to a meeting of predetermined parameters as monitored by the process control means to maintain the concrete stored in the mixer within a predetermined set of values.

DETAILED DESCRIPTION OF THE PREFERRED EMBODIMENT

Figure 1:
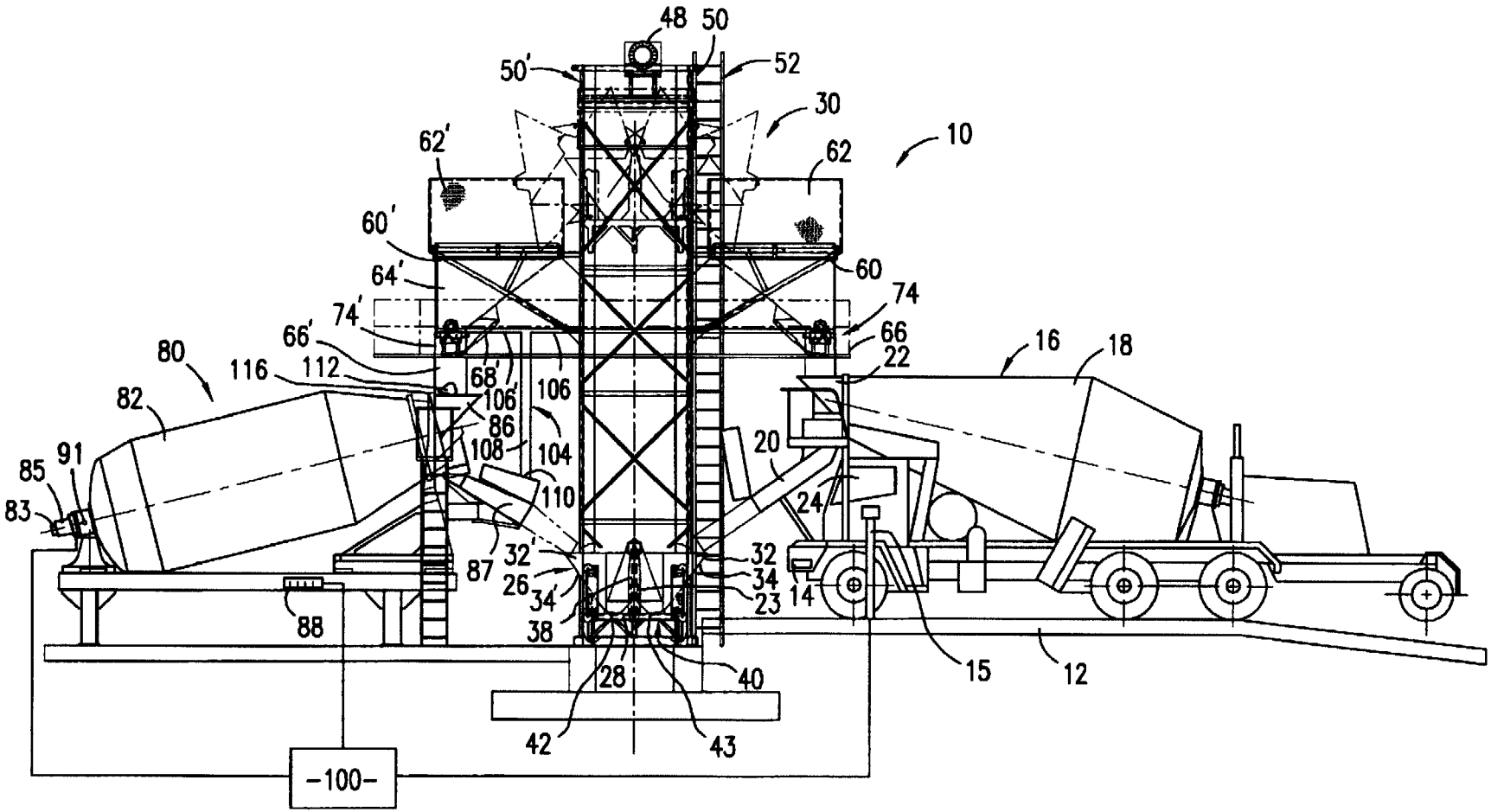
FIG. 1 is an elevational view of the system as used according to the present invention.

Referring now to FIG. 1, there is illustrated a system 10 for reclaiming and temporarily storing unused portions of concrete which are brought back by ready-mix concrete trucks 16 returning from construction sites where the originally loaded full loads of concrete were not used. The system 10 automatically performs five basic functions which are features of the present invention, as will be discussed in greater detail below. These functions comprise receiving leftover ready-mixed concrete from a transport truck 16; stabilizing the hydration state of the concrete for usage at a later time, as long as four days later; washing out the ready-mix transport truck mixer drums or barrels 18; separation for reuse of all washout materials; and discharging of the stabilized concrete for reuse in a new batch of ready-mixed concrete when needed. The system 10 performs these five basic functions by utilizing a number of major assembly component subsystems, which will be discussed in greater detail below.

The system 10 comprises a loading dock 12, a tower structure 30, a bucket 26, a carriage structure 40, a set of stationary hoppers 60,60' including pinch gates 74,74', a storage assembly 80, a rotary power unit 102, and a process controller 100 providing automatic control over a majority of the subsystems once system operation is commenced.

For the convenience in identification herein, the stationary hopper 60, shown on the right side of drawing FIG. 1 will be referenced herein as the front hopper 60 because it will be closest to the truck 16 when initially unloading a batch of concrete. Hopper 60', shown on the left side of the drawing FIG. 1, conversely is referenced as the rear hopper 60'. Other elements associated with the respective hoppers 60, 60' will also have a prime numeral for the left hopper and a non prime numeral identifying the right or front hopper elements when those elements are otherwise identical for each set of hopper assemblies. A similar numeral identification system is utilized with the bucket 26 and the clamping assembly 90,90' referring to the front and rear positions of the elements respectively.

Mixers 18 of the truck 16 and stationary mixer 82 of stationary storage assembly 80, each include internal fins located inside the mixer vessels to "charge" the mixers. Charging the mixer is defined as carrying any material located within the mixers 18, 82 to the bottom of the barrels or drums, thereby agitating and mixing the materials. As defined in this application, "charge" will refer to the rotating of a truck mixer 18 or stationary mixer 82 in one direction to maintain and mix the contained material. Conversely, "discharge" will refer to the action of rotating a truck mixer 18 or stationary mixer 82 in an opposite rotational direction, thereby causing the spiral fins located inside the mixer vessels to carry any material located within the mixers 18 or 82 to the opening located at the top of the mixer to discharge or expel the material. The terms charge and discharge are in common usage by those skilled in the art of operating concrete transport trucks and to concrete suppliers, and are used in that context herein.

Referring to FIG. 1, the system components and their respective functions will be described in greater detail. The system 10 includes a loading dock 12 into which a ready-mix concrete truck 16 is guided. The typical ready-mix truck 16 will normally have a truck mixer 18, a discharge chute 20, truck in-feed hopper 22, and controls disposed either in the truck cab 24 (not shown) or externally disposed controls 14, as shown. The truck operator enters with the truck 16 into the dock 12 and stops the truck with the mixer opening facing the tower 30. Alternatively, the truck 16 can pull up alongside the dock 12, adjacent to the material handling bucket 26, so that discharge chute 20 may be positioned for discharge of concrete into the material handling bucket 26. The dock 12 should be configured to accept both front end discharge trucks 16, as shown, or for conventional rear discharge concrete trucks, as shown in aforementioned U.S. Pat. No. 5,127,740.

The truck mixer 18 is thus positioned adjacent a tower structure 30 of the system 10, which comprises a second major component of the system 10. The tower structure 30 and related equipment provides a fully automatic operating system which is more flexible than the one described in U.S. Pat. No. 5,127,740. Nevertheless, the system taught and described in U.S. Pat. No. 5,127,740 includes several common elements and features with the system of the present invention and, accordingly, the teachings of U.S. Pat. No. 5,127,740 are incorporated herein by reference.

System 10 includes a number of pumps, meters, and hoses (not shown in detail) that provide for addition of water and chemical to the various components of the system. For the facility of description, tower structure 30 of the current invention will be described with reference to four major subsystem components as follows:

First, stationary hoppers 60,60' provide for the temporary storage of material.

Second, a water return pipe assembly 104 comprising a set of valves 106, 106,' a pipe 108, and a spout 110, facilitates the transfer of liquid material from either hopper 60 or 60' to the bucket 26. Liquid held in either hopper 60 or 60' can be released to the bucket 26 by opening either water return valve 106 or 106' to permit the water therein contained to flow down the water return pipe 108, out the spout 110 and into the bucket 26.

Figure 2:
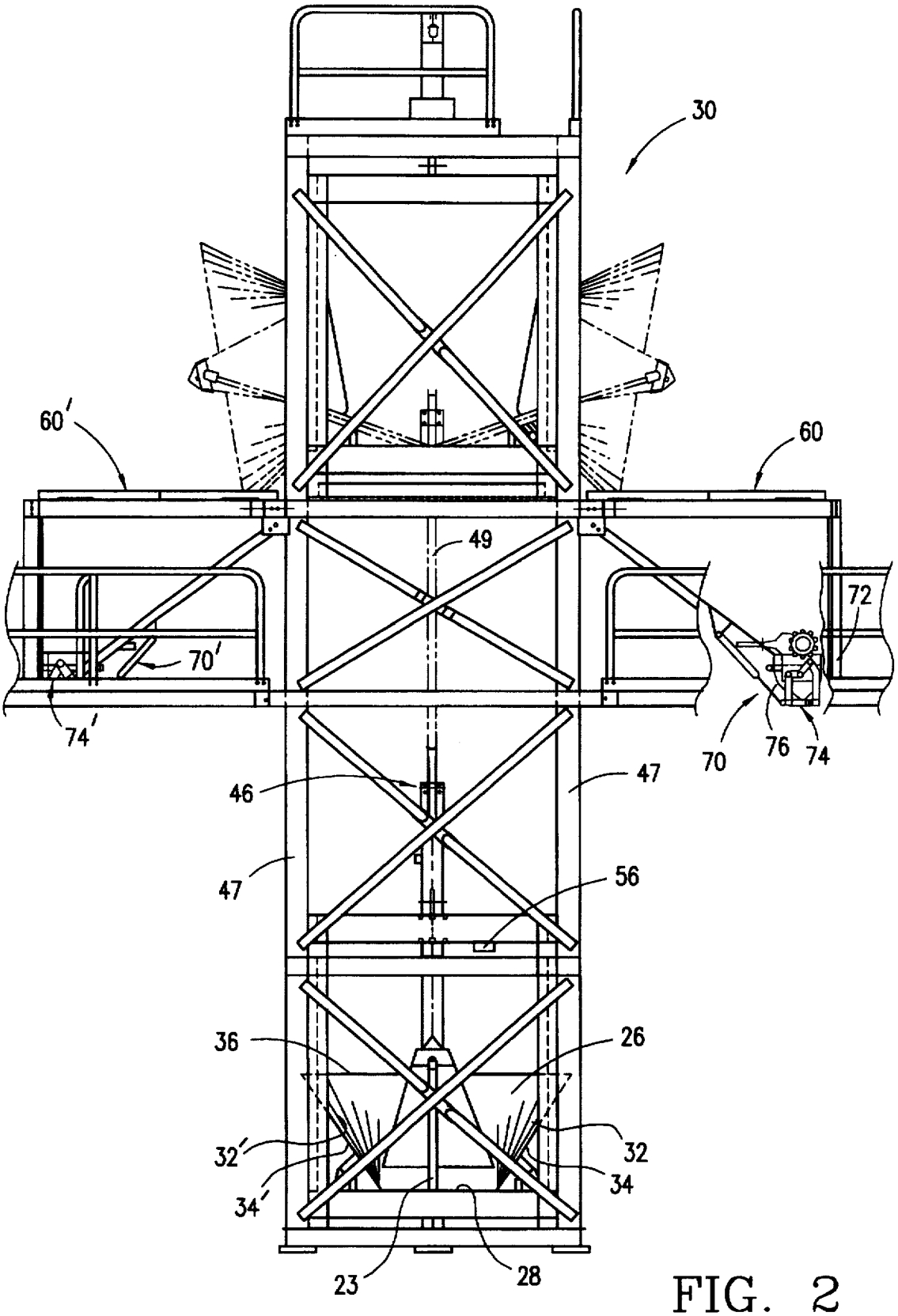
FIG. 2 is an elevational detailed view of a tower structure of the system according to the present invention.
Figure 3:
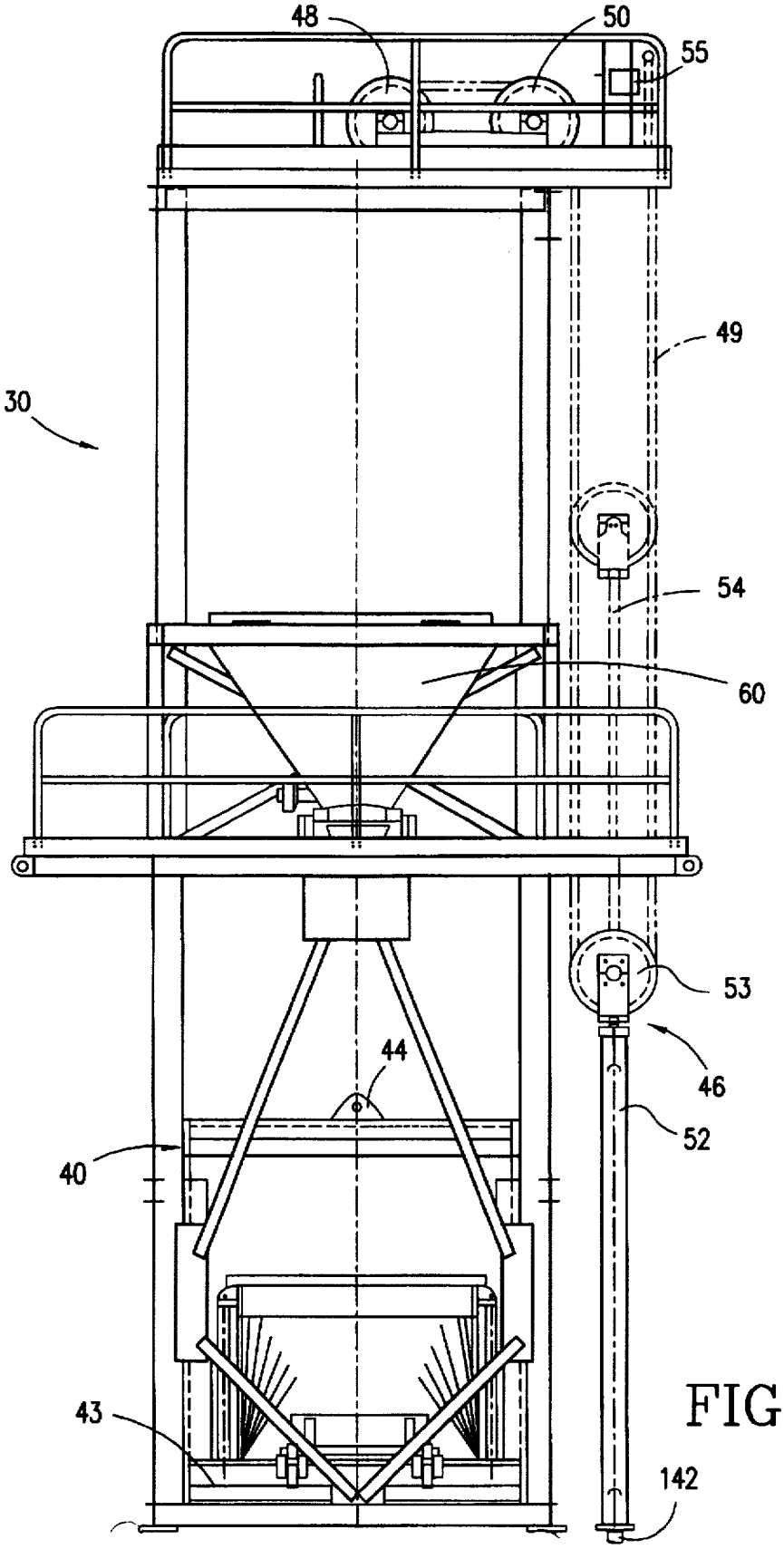
FIG. 3 is a side view of the tower structure shown in FIG. 2.

Third, a lifting mechanism 46 best illustrated in FIGS. 2 and 3, consists of a flexible cable 49 one end of which is secured permanently at the top of the tower structure 30. The cable 49 is drawn to the top of the lift cylinder 52 and is looped through the pulley 53 which is attached to the top of the lift cylinder 52. The cable 49 then is looped through a pulley 50 at the top of the tower structure 30 and through a final pulley 48 located at the center of the tower structure 30 directly above the bucket 26 within a carriage assembly 40. From pulley 48, the cable 49 proceeds is connected directly to the cable mount 44 located at the top of the carriage assembly 40. The lift cylinder 52 preferably has a single shaft 54 with a large stroke, preferably between ten and fifteen feet. This configuration translates one unit of vertical displacement of the shaft 54 into a doubling to two units of the vertical motion of the carriage assembly 40.

Fourth, the tower structure 30 also includes the bucket 26 and the carriage assembly 40 providing for the vertical transportation of the bucket 26 to cable 49. The material handling bucket 26 is somewhat different in construction from that of the bucket 26 shown in U.S. Pat. No. 5,127,740 in that the bucket 26 has a flat bottom 28, rather than troughs, so that it can contain a greater volume of material. However, in other respects, such as the bucket cylinder 23 which is used to tilt the bucket 26, the construction of the bucket 26 is similar and reference is made to U.S. Pat. No. 5,127,740 for structural and operational details. The material handling bucket 26 is intended to tilt and pour concrete or other material in either of two oppositely disposed directions. Thus, the bucket construction includes two spouts a front spout 32 and a rear spout 32' which oppositely are disposed on two spout walls 34, 34' along the rim 36 of the bucket 26.

The bucket 26 must be able to efficiently and effectively discharge all of the concrete contained within it. The two spouts 32,32' are formed for most efficient pouring of concrete and slurry water material. Accordingly, each of the spout walls 32,32' have a shallower slope relative to the horizontal when the bucket 26 is in an upright position, as is shown in the detailed views of FIG. 2. The bucket 26 is designed with sloping spout walls 34,34' to efficiently and effectively receive and discharge concrete and water, to reduce the amount of material build-up during use, to efficiently and effectively facilitate the separation of the sand and stone from the slurry water, as will be more fully described below, and to similarly facilitate the separation of the cement particles from the clarified water during settling, as will be more fully described below.

The other two walls of the bucket 26 comprise generally vertical surfaces to permit the bucket 26 to tilt about an axis between them. The bucket 26 and the tower structure 30 is constructed to permit the bucket 26 to tilt either toward the front or toward the back of the tower structure 30 as is shown in phantom in FIG. 2.

A bottom surface 28 provides a rest surface for the bucket 26. The material handling bucket 26 may have a metered volume, or preferably may include sensors to determine either the volume, weight, or both, of the material contained in the bucket 26. The bucket 26 is conveniently sized to contain approximately 3.25 cubic yards. Knowledge of the weight of concrete contained in the bucket 26 is necessary to provide an indication of the amount and rate of hydration retardant which must be continually added to the concrete in order to retard hydration.

In the automated system contemplated as a feature of this invention, the volume of concrete contained in the bucket 26 can be accurately calculated by a volume sensor device and/or by a weight sensing device. The sensors that detect these parameters include the bucket load cell 55, which measures the weight of material in the bucket 26 and the water level sensor 56, which measures the height of wash water in the bucket by an ultrasonic sensor means. By measuring the height of the wash water in the bucket 26, the volume of material in the bucket 26 may be accurately calculated.

The volume of wash water in bucket 26, as calculated, divided by the measured weight of the material, provides an indication of average density of the wash water. When the average density passes a predetermined threshold level, the automated system determines that the solid constituents contained in the bucket 26 have accumulated to the point required to remove them from the bucket 26 and store them elsewhere in the system 10. This separation cycle will be more fully discussed later. The separate solid constituents are beneficial to the concrete holding process because they add to the overall volume of material that can be reused as well as aid in the stabilization of the leftover material held in the vessel 82 because of the high levels of chemical and water which maybe contain therein.

Thus, the bucket 26 serves the functions of separating the wash water constituents as well as of lifting the material for transfer to another part of the system 10. In order for the bucket 26 to function effectively in its lifting and tilting functions, it is necessary to house the bucket 26 in the carriage assembly 40. Referring now to FIGS. 2–5, and more particularly to FIGS. 4A, 4B, 5A and 5B, the carriage assembly 40 consists of the bucket 26, a plurality of guide wheels 42, a cable mount 44, a load cell 55, a level sensor 56, and two bucket clamping mechanisms 90, 90' alternately disposed on either side of the sloping walls 34, 34' of the bucket 26.

The carriage structure 40 is loosely connected within the framework provided by the tower structure 30 so that it can be elevated vertically up and down along the tower 30. Carriage structure 40 comprises vertical posts 41 on which the plurality of guide wheels 42 are attached and a platform 43 having a surface area capable of providing support to the bottom 28 and to the bucket 26.

The bucket clamping mechanism 90, 90' which allows for automatically tilting and rotation of the bucket 26 in one of two possible directions to facilitate pouring of material from the bucket 26. An alternative embodiment of such a mechanism is described and illustrated in aforementioned U.S. Pat. No. 5,127,740, but in view of the different structure and operation of the tilting and clamping mechanism 90, 90' used in the present embodiment of this invention, a more complete and detailed discussion of the bucket tilting mechanism will be described with reference to FIGS. 3–5 below.

The bucket 26 is held in a vertical position by the platform 43 upon which it rests when the carriage structure 40 is being raised or lowered vertically along the tower 30 by the lift drive mechanism 46. As the lift drive mechanism 46 raises or lowers the carriage structure 40, the guide wheels 42 maintain the carriage structure 40 in the desired position with the platform 43 being horizontally disposed. The distance between two like-oriented guide wheels 42 disposed on adjacent posts 41 of the carriage structure 40 is exactly the distance between adjacent rail guides 47 on the tower 30. The guide wheels 42 glide which may be L-shaped, and either integrally formed or connected to the tower rail guide 47. Thus, the carriage structure 40 is always maintained in an upright position relative to the vertical tower structure 30.

Referring now to FIGS. 4A–5B, one bucket clamping mechanism 90 or 90' is disposed on each opposite sloping walls 34,34' of the bucket 26. The clamping mechanisms 90 or 90' retains one side wall 34,34' of the bucket 26 while the other clamping mechanism 90,90.' Engagement by the clamp 98 or 98' disengages the other side wall of the bucket 26. Engagement of the bucket clamping mechanism 90, 90' is executed by two sets of clamp arms 98, 98' on either end of each clamping mechanism 90, 90'. Engagement by the clamp arms 98 or 98' provides a horizontal pivot around which bucket 26 tilts toward one or the other side when the dump cylinder 23 is caused to be extended. Upon tilting of the bucket 26, the tilted one of the respective sloping walls 34, 34' causes the respective spout 32 or 32' to discharge the contents of the bucket 26 into one of either of the two receiving hoppers 60, 60', or to a diversion chute, (not shown).

Figure 4A:
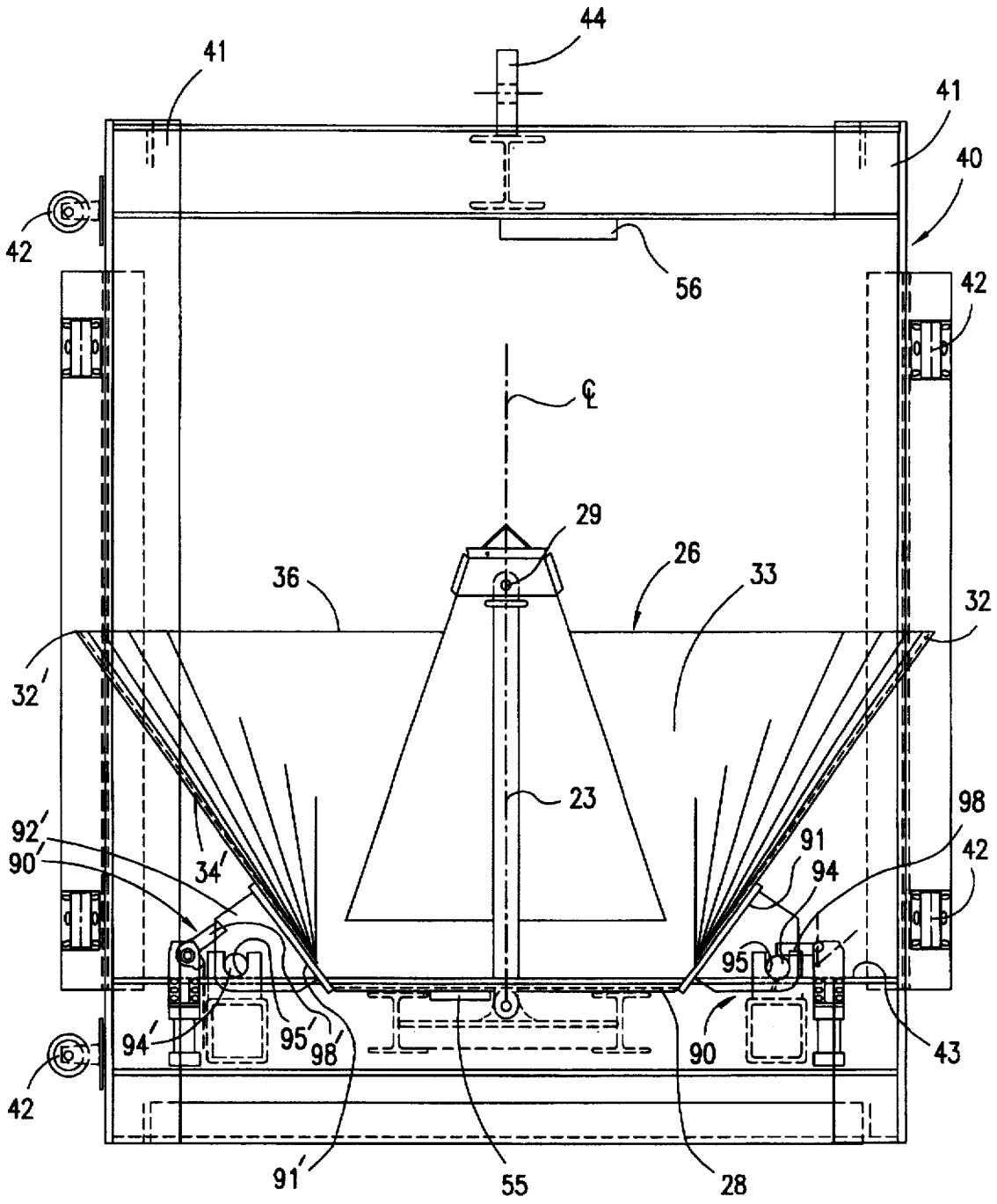
FIG. 4A is an elevational view of the bucket carriage assembly with the bucket in the rest position.

The bucket 26 is configured to be tilted in either of two directions, i.e. seen in phantom in FIGS. 1 and 2 or front and rear as seen from the vantage point of the cab 24. The clamping assemblies 90, 90' required for clamping and tilting the bucket 26 are in most respects the same for the engagement of either wall 32, 32' side of the bucket 26. In FIG. 4A, the clamping assemblies 90, 90' are in mirror symmetry with each other about a centerline CL. The convention, used, herein is the same as that used with reference to FIG. 1, that is, the elements on the right hand, or front, side of the tower 30 or carriage structure 40 are identified by numerals that are not primed and on the left hand, or back, side are identified by the same numerals, but the numerals carry a prime. For the detail view shown in FIG. 5B, all of the elements of the clamping assembly 90' carry a prime since only the rear half of the assembly of bucket 26 is shown.

Referring now to the bucket shown in FIGS. 4A,4B,5A and 5B the bucket clamping mechanism 90' is described. The bucket clamping mechanism 90' is comprised of two subassemblies, one mounted on the bucket 26 and the other on the carriage structure 40. A reinforcement plate 91', two rod support mounts 92' and a rod 94', all disposed on opposite lateral ends of the bucket 26, or extending therebetween. The carriage mounted elements include two rod cradles 95', two rod clamps 96', and one clamp arm 98' for each of the clamps 96'.

The reinforcement plate 91' is welded or otherwise attached to the side wall 34' of the bucket 26 to provide reinforcement to each of the rod support mounts 92' that attach the rod 94' to the sloping rear wall 34' of the bucket 26. Rod support mounts 92' are disposed laterally of each other so that the rod 94' runs in the parallel direction to the bucket pivot 29. Parallelity of rod 94' to the pivot 29 is necessary so that tilting of the bucket 26 will proceed by rotation about the pivot formed by rod 94' rotating within the cradles 95' when the hydraulic cylinders 23 exert upward force on the pivots 29 located on the two vertically disposed side walls 33 of bucket 26.

Rod 94' is shaped and dimensioned for insertion within upwardly disposed, the cup-shaped rod cradles 95'. The cradles 95' provide a retaining and positioning function to receive the rod 94' when the bucket 26 is in the rest position.

Clamp arms 98' are hydraulically or electrically driven to rotate and to engage rod 94° within the cradles 95'. When closed, the clamp arms 98' must provide enough retention force on the rod 94', to hold it within the cradles 95' as the bucket 26 pivots about the rod 94', but must still permit rotation of the rod 94' within the cradle 95' during the pivoting of bucket 26.

The bucket clamping mechanism 90' operates to tilt the bucket 26 in the desired direction. While the bucket 26 is at rest or when the carriage structure 40 is being raised or lowered the clamp arms 98, 98' on both sides of the bucket 26 remain in the closed and locked position. When the bucket 26 is elevated in the tower structure 30, discharge of the material in the bucket 26 occurs at the top-most carriage position within the tower 30 by tilting the bucket 26. In order to tilt the bucket 26, one side the bucket 26 must be released from its closed and locked position. If tilting of the bucket 26 is desired toward the right of FIGS. 1 and 4A, 4B, i.e. toward the front hopper 60, the left-side clamp arms 98' are opened, thus allowing the rod 94' to be lifted from the rod cradles 95'.

As the bucket 26 is lifted upward by the upward pressure of dump cylinder 23 on the bucket pivot 29, the bucket wall 34' will pivot about the rod 94 which is retained within the cradle 95 by clamping mechanism 90. During this process, the spout 32' will rotate about the rod 94 and the bucket will traverse an angular transposition from its position shown in FIG. 4A to that shown in FIG. 4B.

Figure 4B:
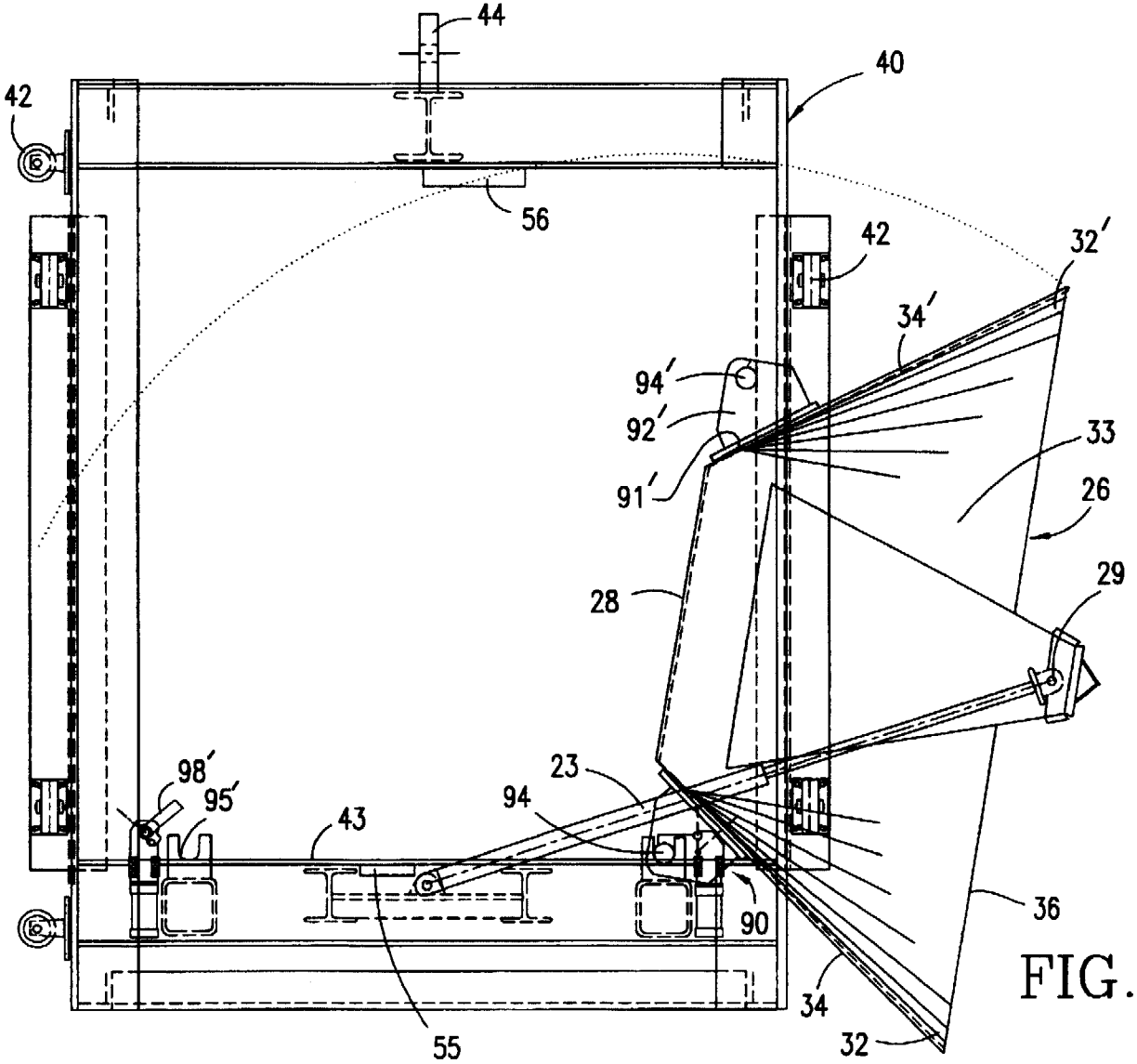
FIG. 4B is an elevational view of the bucket carriage assembly with the bucket in the tilted position.
Figure 5A:
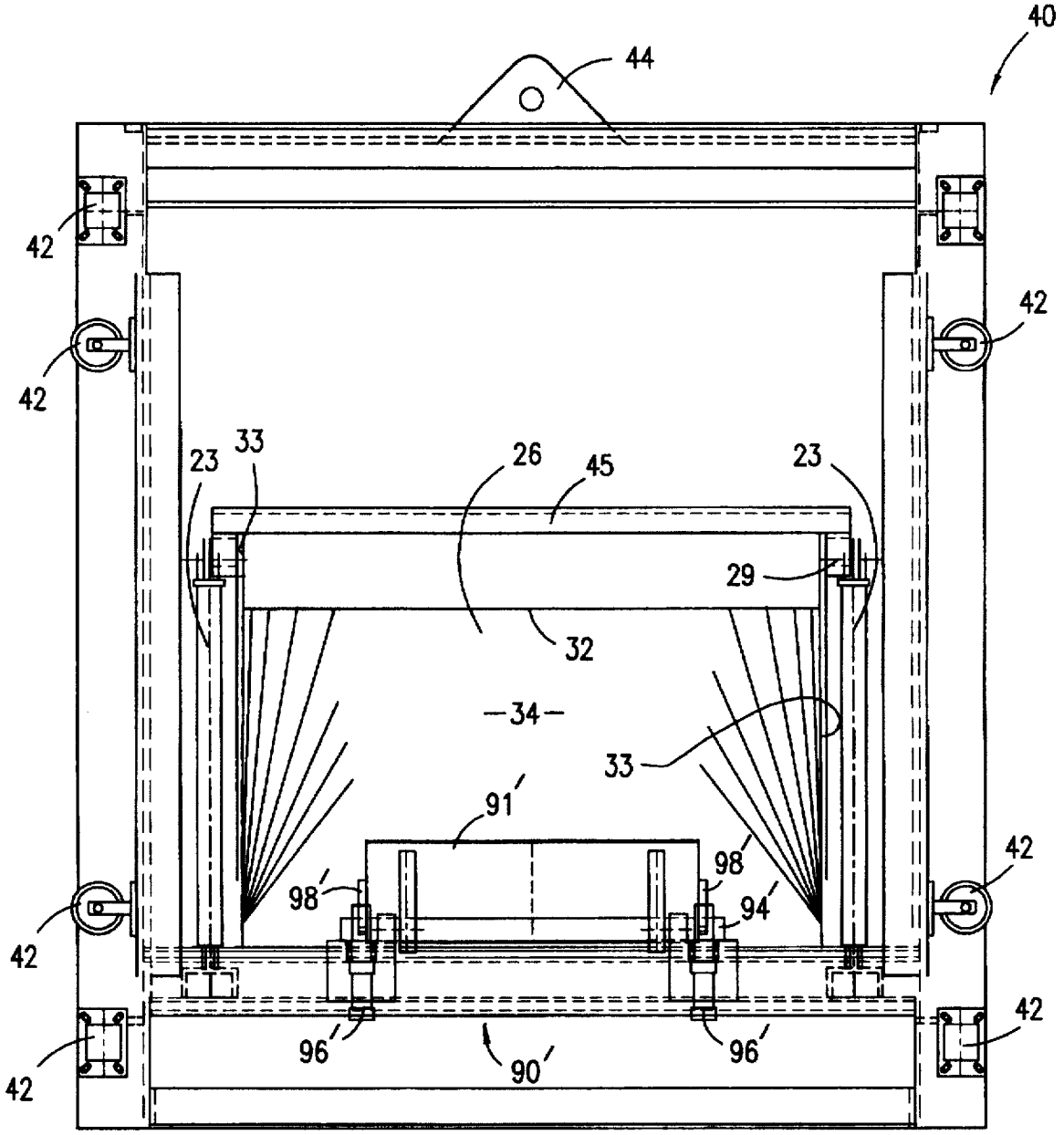
FIG. 5A is a side view of the bucket carriage assembly of FIGS. 4A and 4B showing the bucket in the rest position.
Figure 5B:
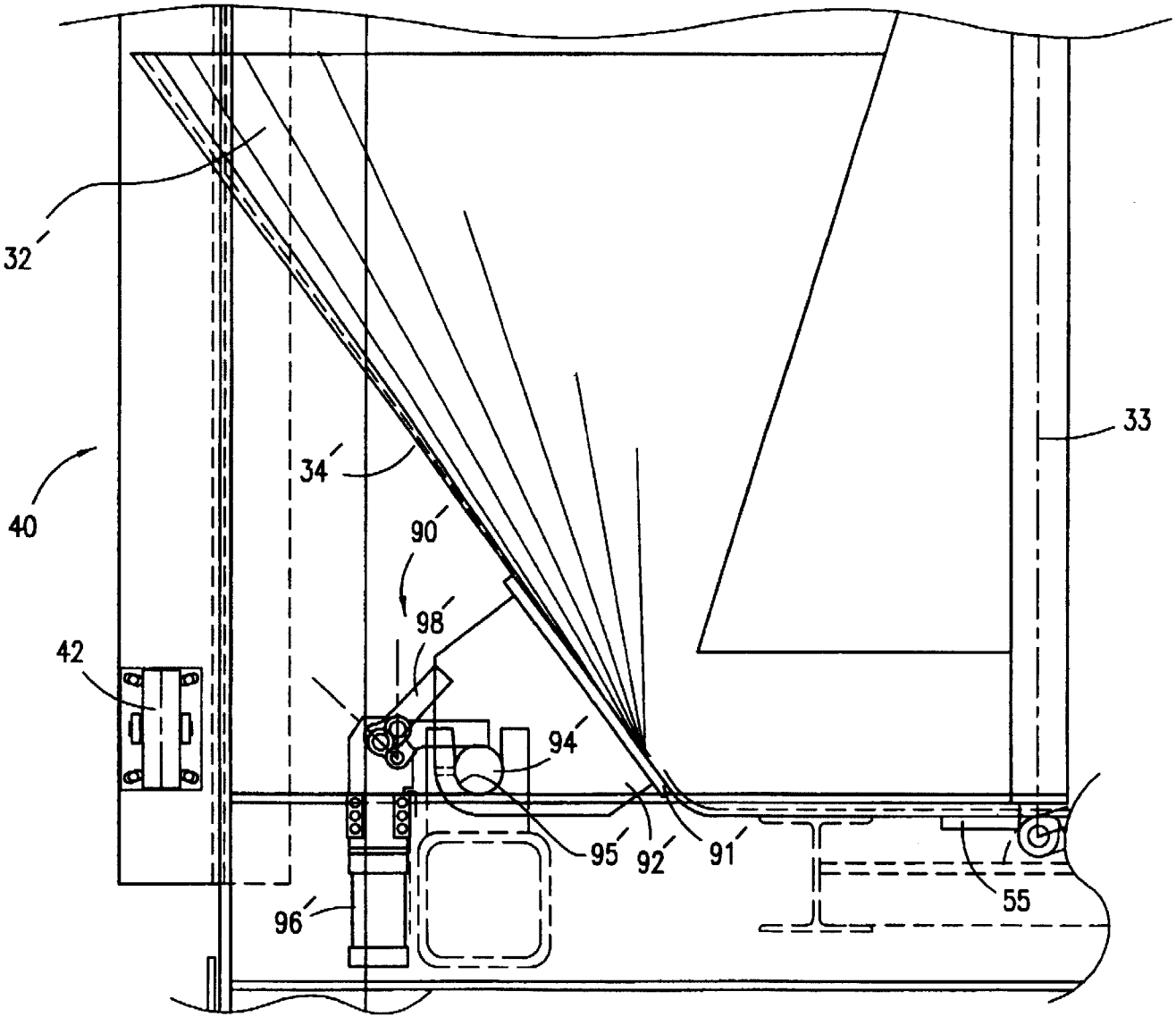
FIG. 5B is a detailed side view of the bucket clamping mechanism.

FIG. 4B illustrates the bucket 26 in the dump position which is defined by the extension of dump cylinder 23 to its fully extended position. In the dump position any material, such as washwater or concrete to be reclaimed is dumped out by pouring from the spout 32.

As the dump cylinder 23, is extended, it exerts upward force on the pivot 29 of bucket 26. The bucket 26 thus tilts around the rod 94 which has been engaged by clamp arm 98. Tilting will thus cause the bucket's contents to be poured into the desired receptacle, e.g. the hopper 60.

After the contents of the bucket 26 are discharged, the bucket cylinder 23 is retracted, the bucket 26 once again comes to rest on the platform 43 and the clamp arms 98' are once again extended to lock the rod 94' and thus the entire bucket 26 is in the rest position. Of course, if clamping mechanisms 90' engages rod 94' and rod 94 is released, extension of dump cylinder 23 will cause the bucket 26 to tilt in the opposite direction, i.e. forward the left as seen in FIGS. 4A and 4B.

The fourth major system 10 component after the bucket 26 and carriage assembly 40 are the hoppers assemblies 60, 60' and pinch gate assemblies 70, 70'. Each hopper 60, 60' is formed in the shape of an offset funnel, each having discharge opening located underneath the respective hoppers 60,60'. Each discharge opening has attached to it the pinch assembly 70, 70', respectively comprising a rubber tubular element or boot 76 or 76'. Each pinch gate assembly 70,70' includes a pinch gate cylinders 72, 72' and pinch gates 74,74' which can open or close rubber boots 76, 76'.

The pinch gate assemblies 70,70' serve the purpose of controlling the flow of material out of the hoppers through the bottom of each hopper 60,60' and, when needed, stopping the flow of material and holding the material within the hopper 60,60' for any period of time. The pinch gate assemblies 70, 70' stop the flow of material through the cylinders 72, 72' by extending the cylinders 72,72' such that a wide surface of the respective pinch gates 74,74' squeezes the circular rubber boots 76 or 76" and pinches flat the boot such that no material can flow through it. Material is allowed to flow a the cylinder 72 or 72' is retracted and the rubber boot 76 or 76' opens to permit gravity to carry the material through the opening.

Referring again to FIG. 1 another component of the system 10 is the storage assembly 80, which consists of the stationary rotatable mixer or holding vessel 82, a hydraulic drive 85, infeed hopper 86, and discharge chute 87. Also attached to the walls of mixer 82, but not shown, are several small temperature probes, a force meter 83 housed within the hydraulic drive 85, and an RPM sensor 91, also housed within the hydraulic drive 85.

Another component of the system 10 (not shown in FIG. 1) is the main hydraulic power unit which drive the several hydraulic elements of system 10, such as the hydraulic dump cylinder 23. A typical hydraulic power unit may be used that includes several off-the-shelf components, e.g. a 100 horsepower electric motor, pumps, valves, hoses etc. As will be explained below, the process controller 100, described in more detail below, provides a controlling function to open or close valves, thereby, activating desired hydraulic components of the system 10.

The process controller 100 consists of a central processing unit or CPU 120, a rack 130 which receives various interface modules, such as output modules 122, for sending signals to the various hydraulic components of the system 10, and input cards 124 which receive signals from various sensors, such as proximity switches 132, the load cell 55, ultrasonic level sensor 56. Other inputs are also received by the process controller 100 and directed to other inputs receptors, e.g., to a temperature input card 126, which receive signals from environmental sensors, such as, for example, temperature sensors 89, or to a high speed counter card 128 which receives signals from the chemical and water meters 114, 118 respectively. Also included in the process control unit is the operator interface 134.

All components of the control system are off-the-shelf components which are commonly known to those skilled in the art of automatic controls. Preferably, these may comprise the following industry standard components available from Allen-Bradley Company Inc. of Milwaukee, Wis.

Central processing unit 120: SLC 5/03 part #1747-L532

Rack 130 slot rack part #1746-A13

Output modules 122 120 VAC output modules part #1746-0A16

Input cards 124 120 VAC input modules part #1746-IA16

Operator interface Panel View 550 TSOI

All of the functions of the entire material handling and concrete stabilization aspects of the system 10 can be operated and monitored automatically via the operator interface 134, as will be more fully described in reference to FIGS. 6–11 below. Of course, various safe guards and manually operated on-site controls will be included in the process controller system 100, such as controls 14.88, which can override the controller CPU 120 in an emergency or in the rare event of the system deficiency.

The CPU 120 has been programmed to receive signals from all the devices on the system 10 to input them into the appropriate input cards 122, and to send signal outputs from the output cards 124 of the appropriate signals which control the various system components which perform the described cycles.

Figure 12:
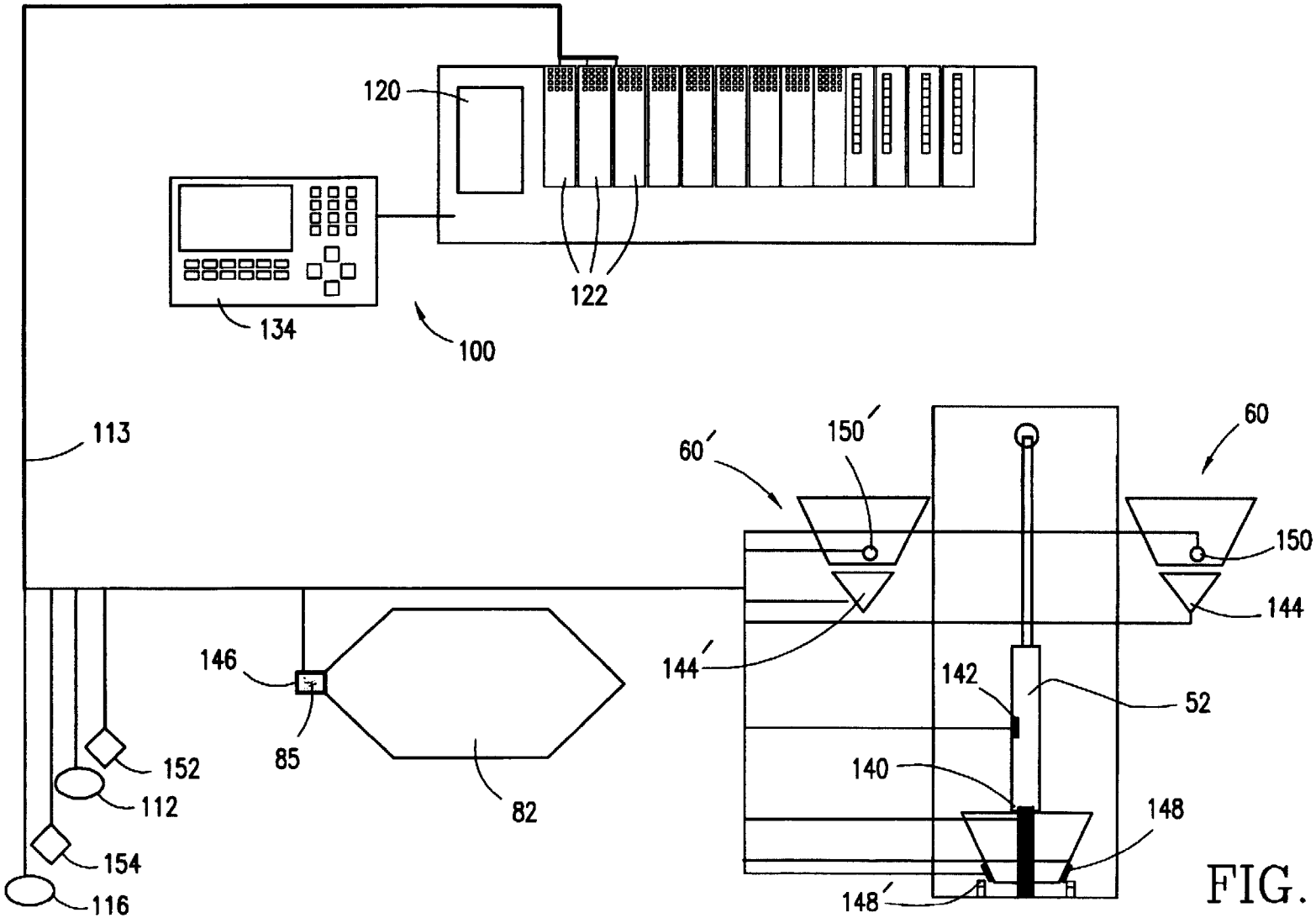
FIG. 12 is a schematic diagram of the system outputs according to the present invention illustrating the interrelationship of the process control unit with the system control architecture.

The CPU 120 receives and sends signals in accordance with the software programming of the system. For instance, in order to elevate the bucket 26, the software commands the CPU 120 to send a signal via the output module 122 to the lift cylinder solenoid 142 (FIG. 3), which allows the flow of hydraulic fluid to compress the lift cylinder 52 and elevate the carriage assembly 40. Similarly, all hydraulic components shown in FIG. 12 are controlled by the software which operates CPU 120 to send a signal to the appropriate solenoid that allows the flow of the hydraulic fluid to actuate the hydraulic device, for example solenoid 142 for lift cylinder 52 solenoid 144 for dump cylinders 23, solenoid 146 mixer drive 85, for bucket clamps 96, 96.' Solenoids 148, 148'.

The water pump 112 and chemical pump 116 are electrically powered devices which receive signals from the output modules 122 through an electrical bus 113. When the software induction of chemical, a signal is sent to the chemical pump solenoid valve 154 to open, allowing chemical to move there through. Simultaneously, a signal is sent to the chemical pump 116 to begin pumping.

Figure 13:
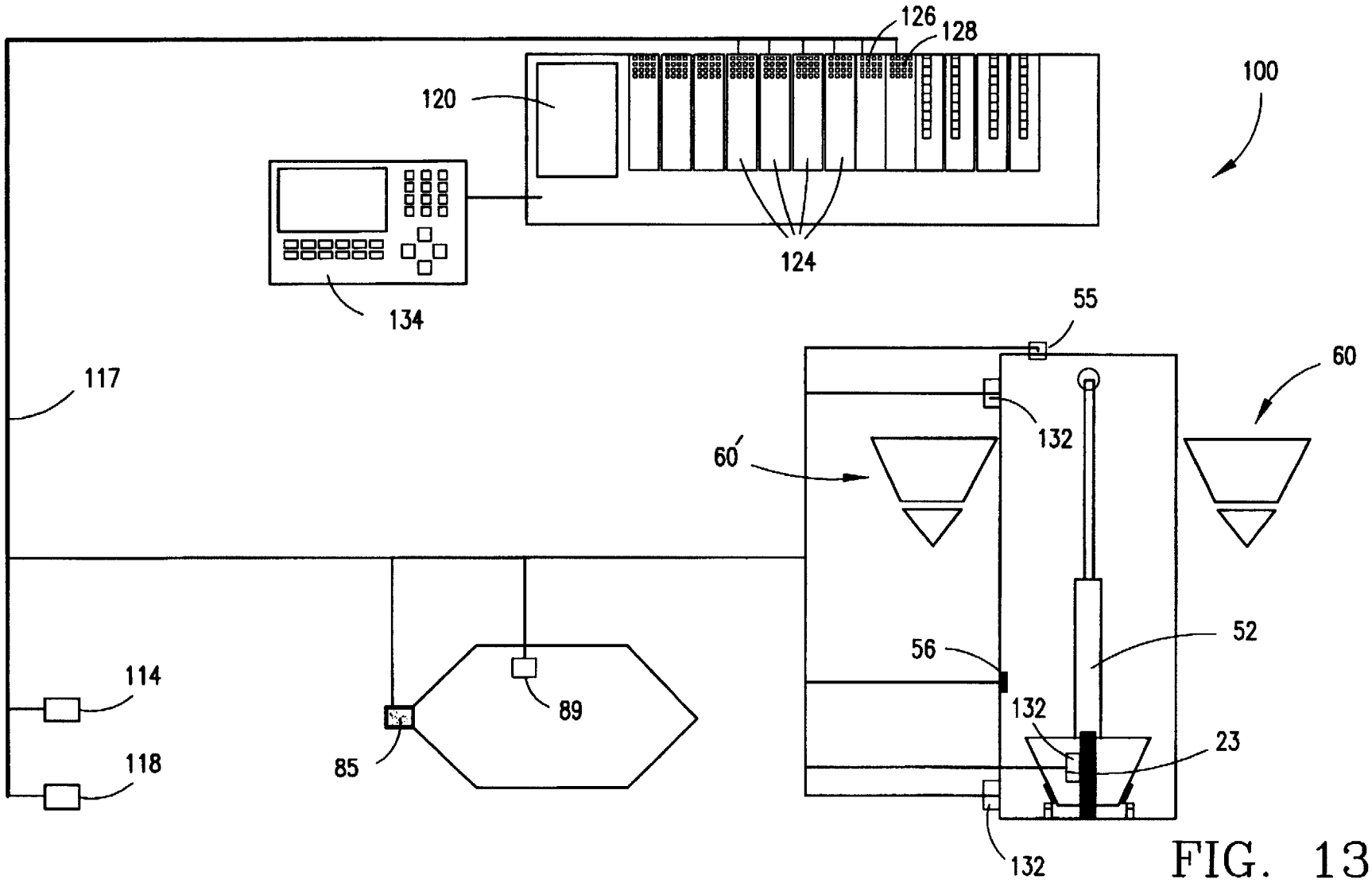
FIG. 13 is a schematic diagram of the system inputs according to the present invention illustrating the interrelationship of the process control unit with the system sensor architecture.

The controller 100 then receives the signal sent from the chemical meter 118 via the high speed counting module 128 (FIG. 13). The meter 118 sends the signal at a rate of one pulse per fluid ounce of chemical that passes through the meter 118. The pulses are summed by the CPU 120 until they equal the number of pulses demanded by the software at which point signals are sent to close the solenoid valve 154 and shut off the chemical pump 116.

Referring now to the master cycle chart FIG. 6, the five major functions of the system 10 will be described. Each one of the five major functional operations of system 10 is discussed in detail in FIGS. 7–11. The overall master cycle chart shown in FIG. 6 ties these operations into functional whole, and is intended to illustrate a preferred embodiment of the method of use of the system 10 in an easily understood format.

Figure 6:
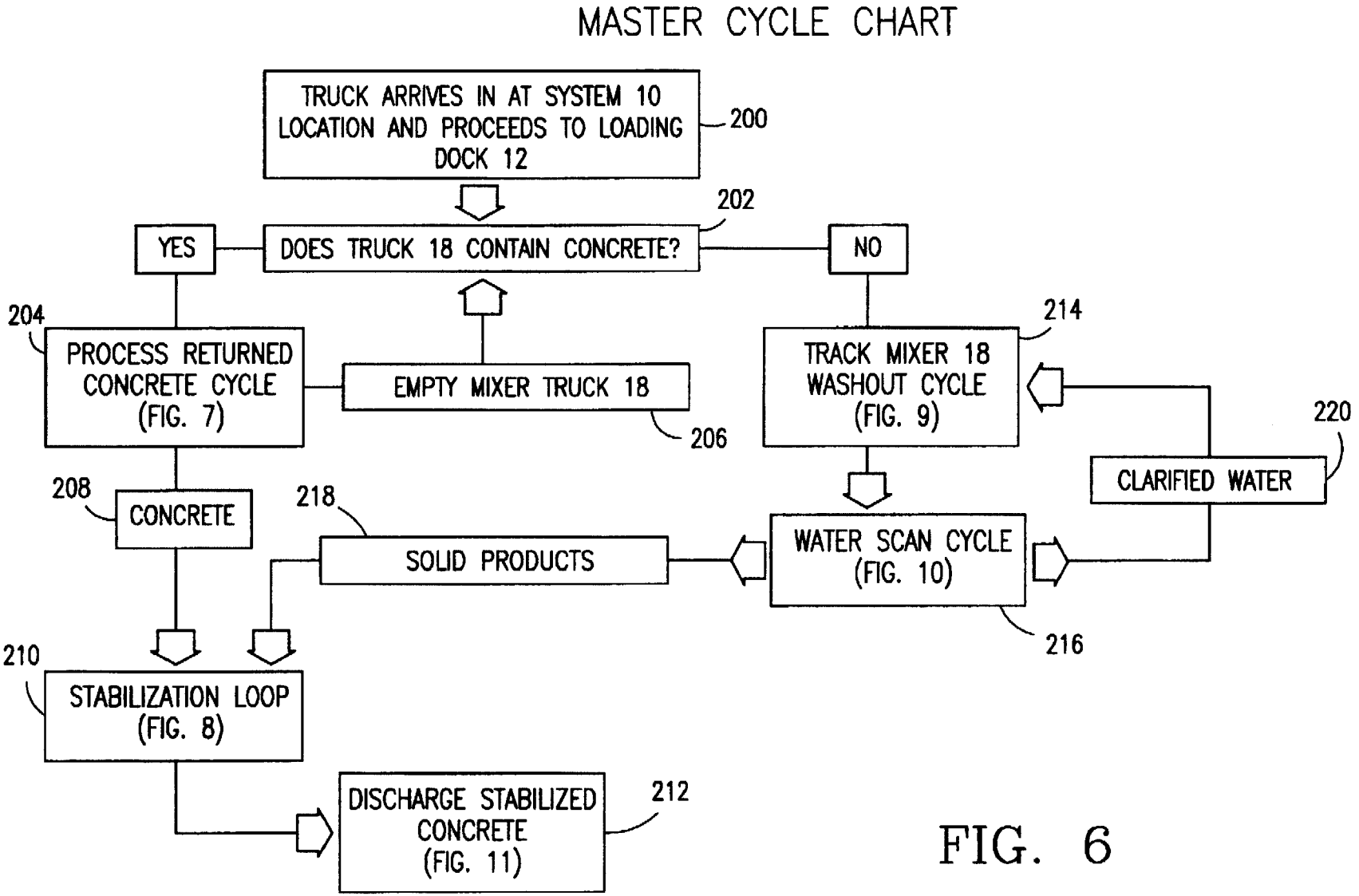
FIG. 6 illustrates an overview layout of a master chart illustrating the interrelationship of the various cycles according to this invention.

Referring now to FIG. 6, step 200 indicates the transport truck 16 is received at the dock 12 of the system 10. The process controller 100 inquires of the truck driver at step 202 by means of the operating control circuit 15, whether the truck mixer drum 18 contains concrete. If response is yes, the controller 100 proceeds with processing the returned concrete, step 204, as will be described in greater detail with reference to the process return and concrete cycle shown in FIG. 7.

The concrete received in step 204 proceeds to the stabilization loop, step 210, as shown by step 208. Step 206 shows that after the concrete has been received by the system 10, the system 10 must confirm that the mixer 18 is indeed empty before it is washed out in step 214. After the concrete has been stabilized in step 210, FIG. 8, it is discharged on demand 212, as will be more fully described in FIG. 11.

The empty mixer truck 18, is washed out in step 214, as will be more described in greater detail with reference to the mixer washout cycle shown in FIG. 9. The water scan cycle 216 is as described in greater detail with reference to the water scan cycle shown in FIG. 10. The water scan cycle facilitates the separation of the solid constituent products 218 from the clarified water 220. The solid products are used in conjunction with the stabilization of the concrete, and the clarified water is used for washing out additional truck mixers 16, as shown by the arrows in FIG. 6.

Figure 7:
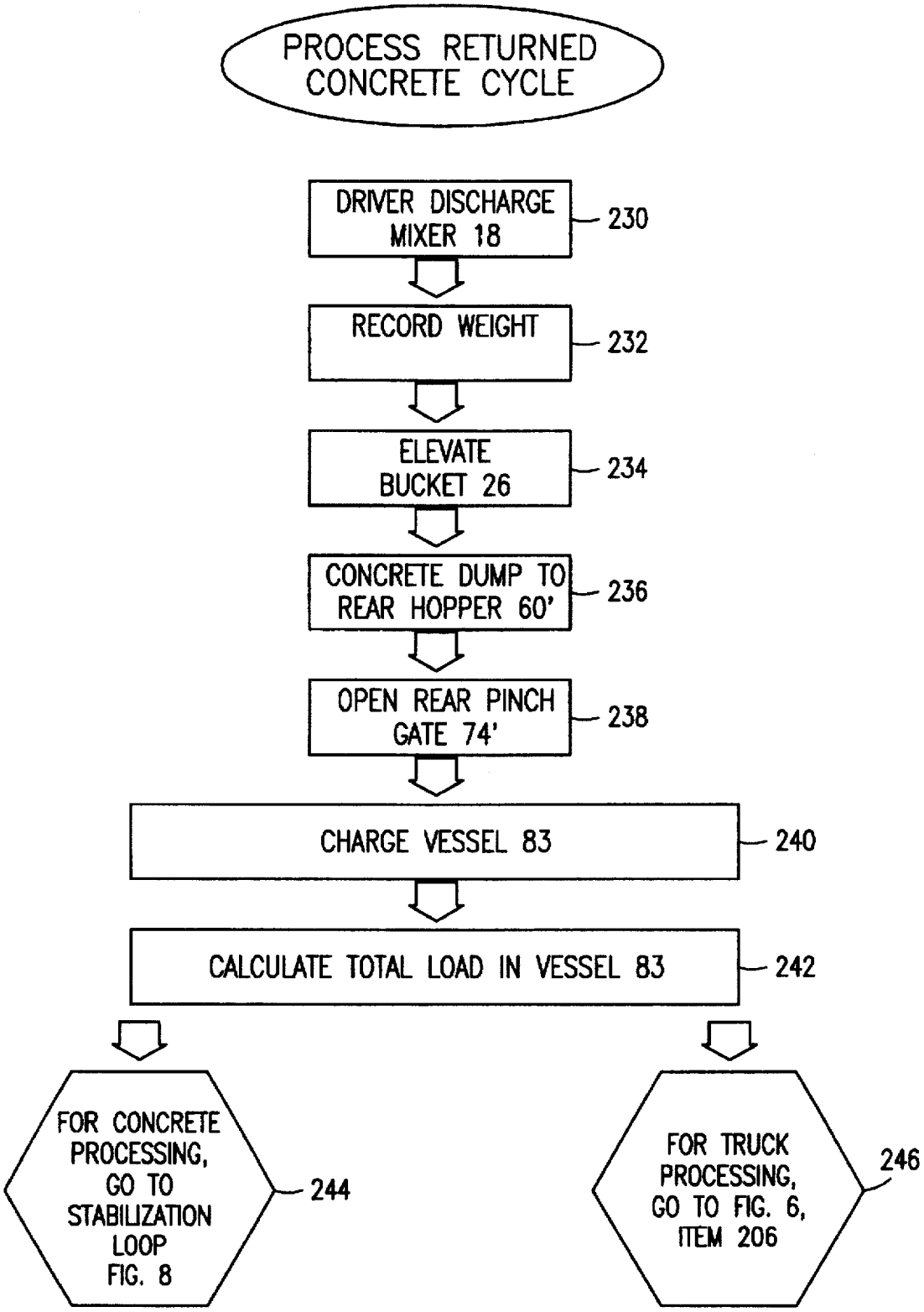
FIG. 7 illustrates a detail flow chart of the initial processing of the returned concrete cycle of the system, which is a feature of the present invention as shown in FIG. 6.

Referring now to FIGS. 6 and 7, the cycle used to receive returned concrete from the ready-mix truck 16 which has returned from a job site with an unused portion of concrete will be fully described. The driver positions the truck 16 on the loading dock 12 such that concrete may be discharged efficiently from the truck mixer 18, step 230. The driver rotates the drum 18 such that the fins on the inside of drum 18 push the material to the opening of the drum 18 causing the reclaimed concrete to flow down the discharge chute 20 and into the bucket 26. The process controller 100 records the weight of the material in the bucket 26 by means of the bucket's load cell 55, step 232. The process controller 100 elevates the bucket 26 within the tower structure 30 to the top of the tower 30, step 234, where the bucket 26 is tilted to discharge all the concrete into the rear hopper 60', step 236.

The storage vessel 82 is rotated in the charge position so as to receive the contents of the bucket and push the contents to the lowest portion of the vessel 82, step 240. The pinch gate 74' located at the bottom of hopper 60' is released, step 238, thus allowing gravity to carry the concrete through the rubber boot 76' and by means of the infeed hopper 86 into the storage vessel 82.

The process controller 100 by appropriate instructions to the CPU 120, calculates the total load in the storage vessel 82 by adding the new load weight to the known weight of the material already stored in the vessel 82, step 242. This batch of concrete is then processed according to the stabilization loop described below with reference to FIG. 8. The truck mixer 18 must still undergo specific procedures before being taken out of commission for the day. For example, the truck 16 may contain a volume of concrete greater than the bucket 26 can hold at one time the process for unloading the mixer 18 must again be repeated as if the truck is newly arrived to the unloading dock 12. That is, the process again refers to the master cycle where the truck drive is again queried whether the truck mixer 18 contains concrete, step 202 (FIG. 6). If the response is yes, a portion of all of the remaining concrete in truck mixer 18 is unloaded into the bucket 26 and is processed again according to the process returned concrete cycle shown in FIG. 7 and described above. Conversely, if the response is negative, the truck 16 commences further processing according to the truck mixer washout cycle (step 214, (FIG. 6)) which will be described below with reference to FIG. 9.

Figure 8:
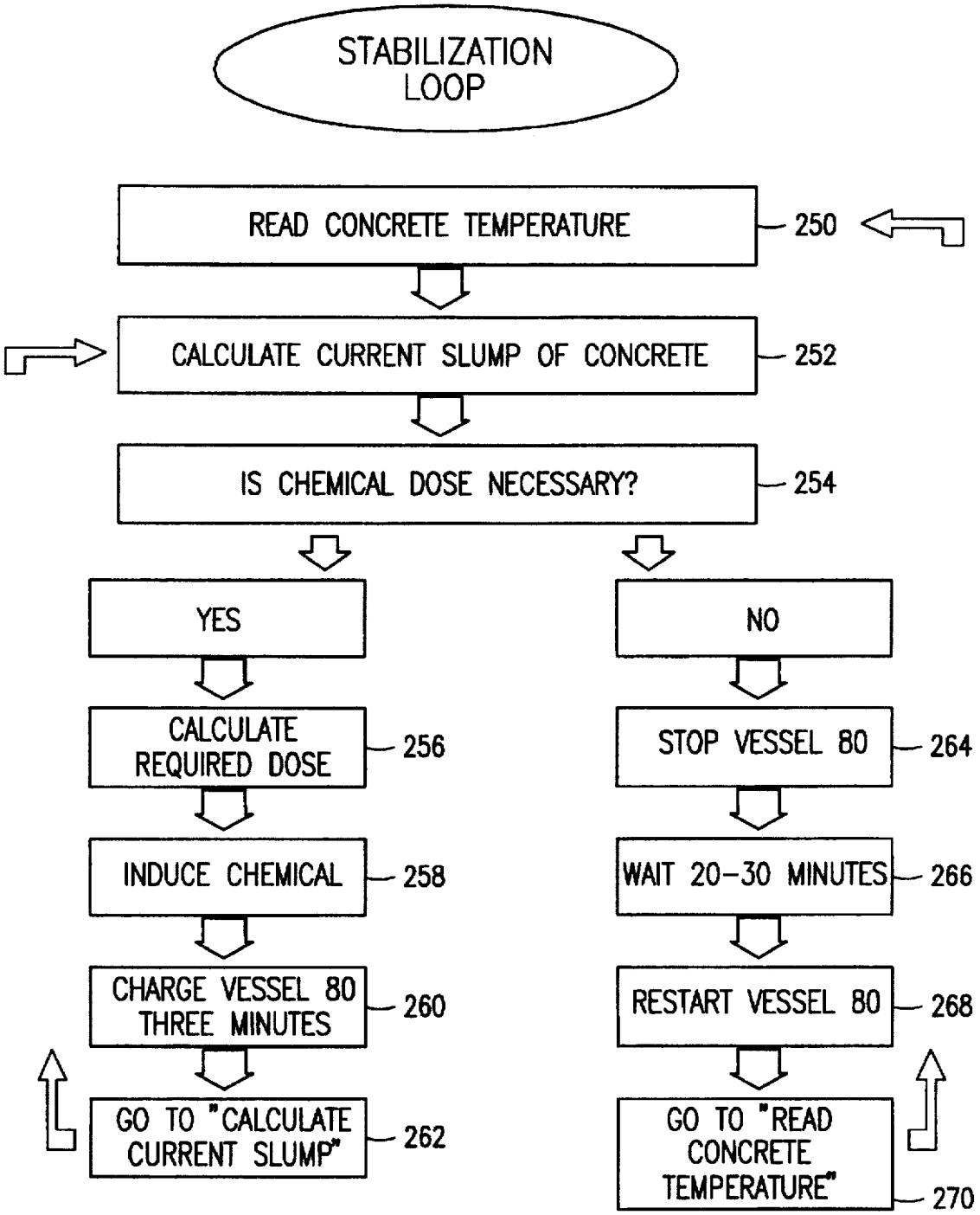
FIG. 8 illustrates the stabilization loop cycle which is a feature of the to the present invention as shown in FIG. 6.

Once all of the concrete from a truck mixer 18 is unloaded into the stationary mixer 82, the concrete in the mixer 82 is stabilized according to the concrete stabilization loop in FIG. 8. FIGS. 6 and 7 refer to the concrete stabilization cycle which is fully illustrated in FIG. 8. After the returned concrete has been received by the mixer 82, see steps 204 and 208 (FIG. 6), the concrete must be carefully monitored and hydration stabilized for a period of time, in order to ensure not only that the concrete does not set up during that period, but that the concrete is in the optimum condition for dispensing at a future time. The length of the period is not always known beforehand and so it is preferable that the concrete in mixer 82 be maintained in a state so it is ready to use at any time.

Other chemical methods of stabilizing concrete require an operator to use a series of tables to calculate the amount of retarding agent to add to the concrete. After the chemical has been added, the concrete will not be able to be poured again until either the calculated amount of time has passed and/or the accelerating agent is added to the concrete. The method described herein monitors the condition of the concrete in the vessel 82 and adds the retarding or stabilizing agent only as the processor 100 deems it necessary. The system according to the present invention maintains a viable product at all times and eliminates significant errors related to dosing calculations and/or expected environmental conditions.

Referring now to FIG. 8, the processor 100 monitors the concrete at step 250, reading the concrete temperature from an infrared sensor strategically located inside the vessel 82. Concrete temperature is one indicator as to the condition of the concrete because the hydration or setting of concrete is an exothermic process. Therefore, heat is given off, which is detected by the sensor, as the concrete sets, or hydrates.

The second indicator of the condition of the concrete is the slump of the concrete calculation in step 252 utilizes the signal data from the sensors to provide inputs to the CPU 120 which calculates the slump of the concrete. The slump is determined from the signal data representing the weight of the concrete in the vessel 82, which has been calculated in FIG. 7, step 242, and the amount of force which is necessary to be exerted by drive motor 85, as measured by the pressure transducer which is housed inside the drive motor 85 of the stationary mixer assembly 80. The process controller 100 takes these two sets of data as variables representing total weight in mixer 82 and force for rotation there to determine the "current slump value."

The current slump value is calculated in step 252 and is compared to the set point defined in the programming of the process controller 100. From the current slump value, the process controller determines whether a chemical dosage of hydration retardant should be added to the concrete mix. If such a chemical dose is determined to be necessary in the comparison step 254, step 256 calculates the amount of dose of the concrete, taking into account several variables such as, the current concrete temperature, change in temperature since the last cycle, the total weight of concrete in mix 82, the current slump and the change in slump since the last calculation. The changes in temperature and slump are indicators of the status of the hydration state of the hydration state of the concrete. That is, the rate of change in either of them also provides valuable data in that if the temperature increases dramatically and/or the slump gets more stiff between cycles, the process controller 100 is programmed to respond with a higher dose of chemical. Alternately, if the concrete had achieved the set point in a more gradual manner, the process controller 100 responds with a lower dose of chemical.

The calculated amount of chemical retardant is added to the mixer 82 either directly or through the hopper 60. The mixer vessel 82 is charged in step 260 so as to homogeneously distribute the chemical throughout the entire load of concrete. In most instances, a three minute period of charging is sufficient to perform the even chemical additive distribution. After the mixer 82 is charged for the period, the program returns system operations to step 252 to confirm that the chemical additive had the desired affect of decreasing the concrete slump, and the slump determination step 262 is repeated. If the slump has not responded to the chemical, comparison step 254 will again require chemical additive, and the process controller 100 will continue to add chemical until a predetermined value of concrete slump has once again been attained.

One feature which derives from this procedure may be used to add retardant in doses which are conservative relative to the calculated dose. One problem of adding chemical retardant is overdosing, which makes the concrete too fluid and liquid. Concrete which has too much chemical retardant additive is not usable for an immediate concrete pour both because the concrete takes too long to set. The process controller 100 of this invention may be programmed to provide slightly less than the calculated dose of retardant to the mixture in mixer 82, and to complete the dosing during a subsequent three minute cycle by adding a smaller increment of chemical retardant with each passage through the loop. Eventually, the concrete slump reaches the optimum value when enough chemical of retardant has been added, thus avoiding overdosing.

Once the concrete has responded to the chemical and the comparison step 254 determines no more chemical retardant is necessary, rotating of the mixer vessel 82 ceases step 264, and a waiting period of 20–30 minutes is programmed in step 266, before the mixer vessel 80 is restarted in step 268 and the cycle is repeated, step 270.

The stabilization loop illustrated in FIG. 8 is intended to provide continuing operation for monitoring the concrete in the stationary mixer 82 and adding chemical hydration retardant to maintain the proper slump of the concrete. Of course, it is contemplated that the operation of stabilization loop will cease should the stationary mixer 82 be completely emptied, for example, when the concrete in the mixer 82 is discharged into a truck mixer 18 in accordance with the discharge stabilized concrete cycle, which will be discussed below with reference to FIG. 11. It is also contemplated that a washout cycle of the stationary mixer 82 be necessary upon emptying the mixer 82 to avoid concrete residue setting and building with the mixer. The washout cycle may be used for washing out the stationary mixer 82 may be similar to the washout cycle used for a truck mixer 18 described in detail below with reference to FIG. 9.

Figure 9:
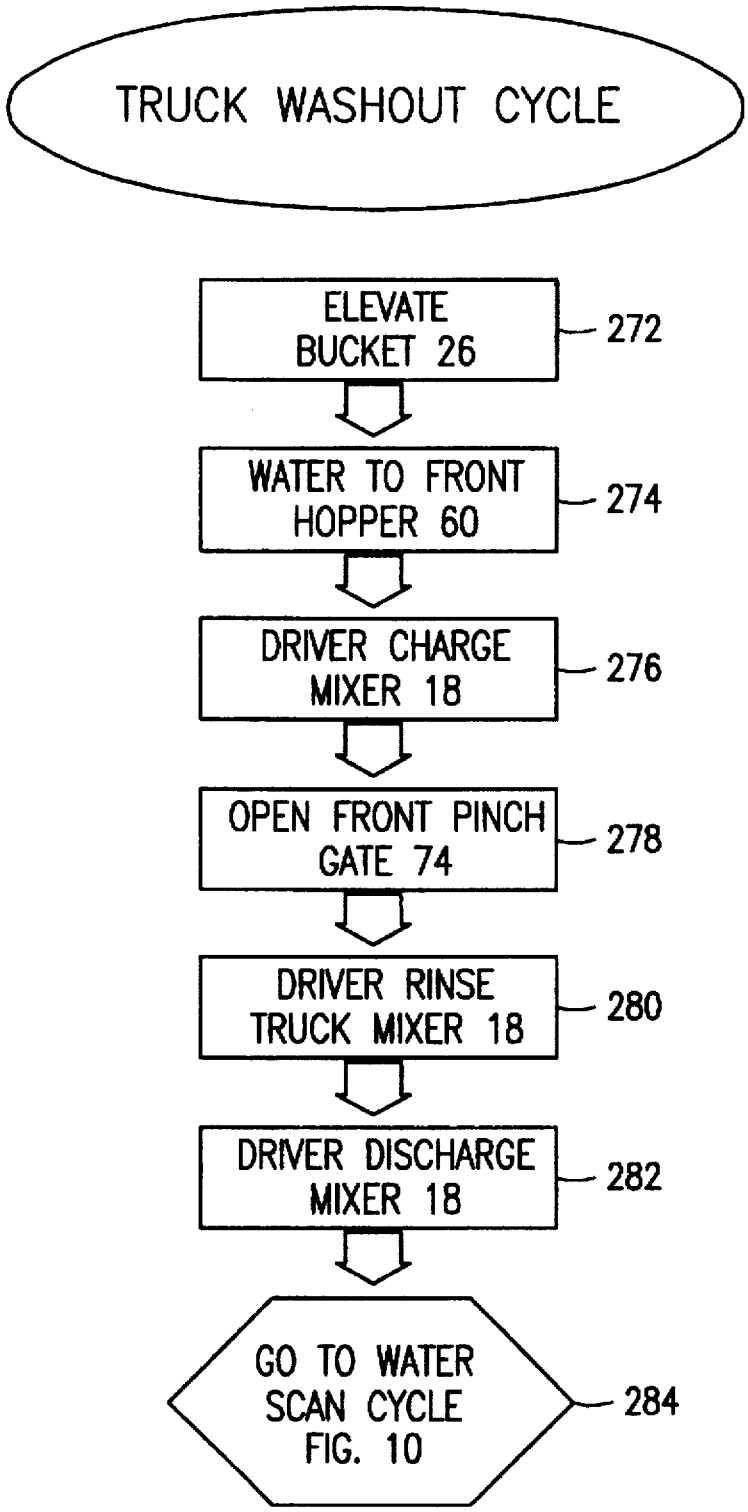
FIG. 9 illustrates a detail flow chart of the truck wash out cycle of the system which is a feature of the present invention as shown in FIG. 6.

Referring now to FIGS. 6 and 9, the method for washing out a truck mixer drum 18 will be described in detail. When the system 10 is placed into operation, a sufficient amount of water, typically 150 gallons, is placed into the bucket 26. Concrete retardant or stabilizing chemical additive is added to that water within bucket 26 in sufficient quantities, normally between 10 and 50 ounces. Alternatively, the chemical additive water may be added through a pump system attached to hopper 60' or the infeed chute attached to mixer 32.

This stabilizing chemical functions well as a washing enhancement to the water, as well as a stabilizing agent. After discharging its concrete load completely, a transport truck 16 is positioned under the front hopper 60 and prepares for the washout cycle by charging or rotating his mixer drum 18 in such a manner as to receive the wash water that has been prepared in the bucket 26.

Referring now to the truck mixer washout cycle, (step 200, FIG. 6) and the process controller 100 has confirmed that the truck mixer drum 18 is empty step 202. The truck washout cycle (FIG. 9) commences in step 272 when the bucket 26, containing the washout mixture of water, chemical, and possibly some suspended cement particles, is elevated within the tower structure 30 (FIG. 1), to the top of the tower structure 30. At that position, the bucket 26 is tilted, as described above, and the mixture is poured into the front holding hopper 60, step 274. The driver charges the truck mixer 18, step 276, so as to receive the water and chemical retardant mixture. The front pinch gate 74 is then opened, step 278, such that the contents of the front holding hopper 60 is released and induced by means of hopper 22 into the truck mixer drum 18. The driver rotates the truck mixer 18, back and forth in such a manner as to rinse all surfaces inside his drum 18 such that the chemically enhanced wash water mixture has the opportunity to clean all internal surfaces. The driver then discharges all material from his mixer 18, step 282, and the material flows down chute 20 (FIG. 1) and into the bucket 26. The process controller 100 then shifts operation of the system 10 to the water scan cycle (FIG. 10) where the water mixture is evaluated for possible separation of its constituent materials.

Figure 10:
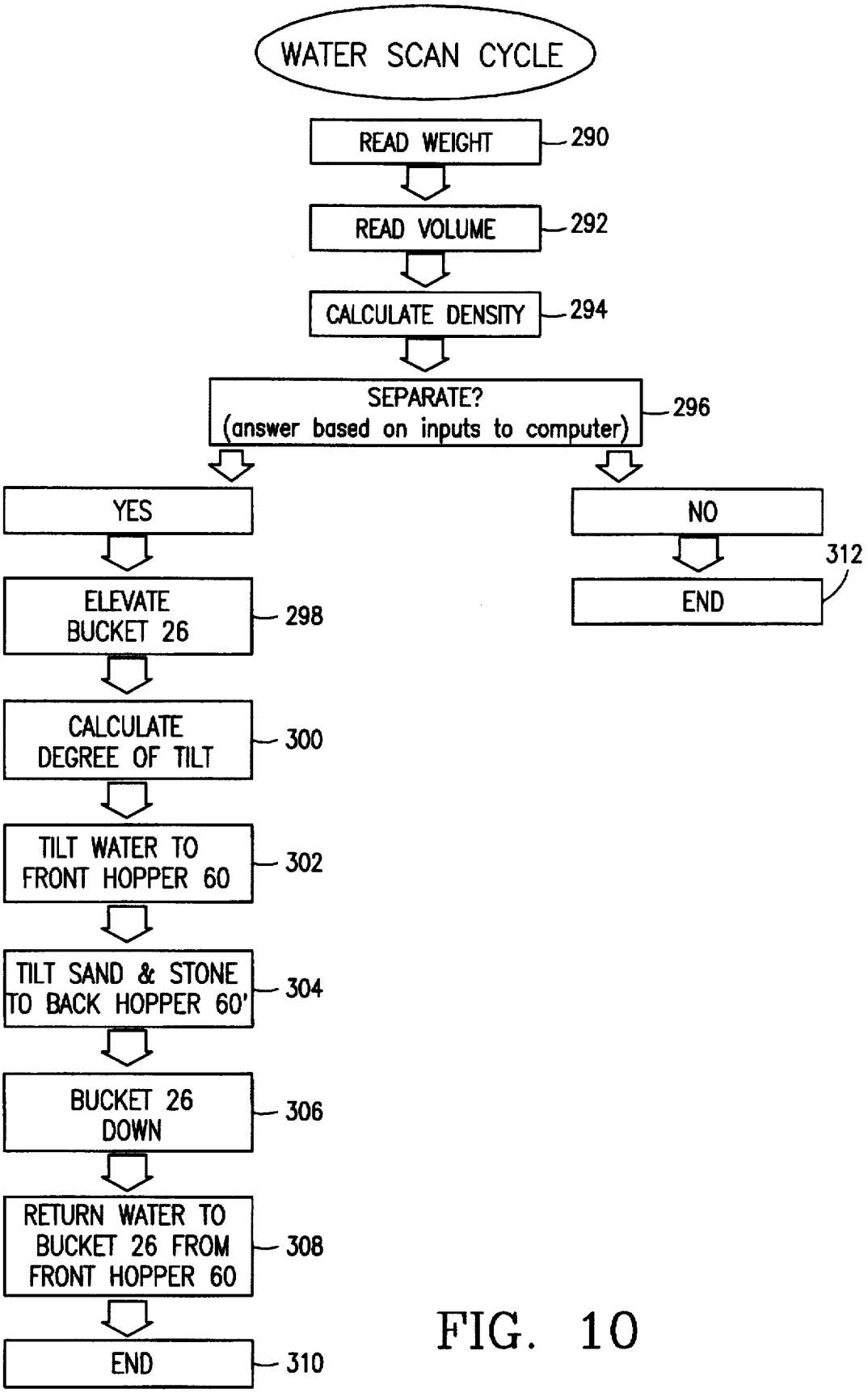
FIG. 10 illustrates a detail flow chart of the water scan cycle of the system which is a feature of the present invention as shown in FIG. 6.

Referring now to FIGS. 6 and 10 the water scan cycle will be described in detail. The system 10 provides an improved method for washing out the mixers 18 of trucks 16 and provides for separation of the components of the washwater which is discharged from the mixer 18 after washout. As understood by persons having ordinary skill in the concrete reclamation art, the terms used in this description are defined herein as follows:

- Wash water: all components of the mixture that is discharged from the transport truck mixer 18 and before any separation of the consistent materials.
- Sand and stone mixture: the mixture of sand, stone, and some cement particles that settle to the bottom of the bucket 26 upon discharge from the transport truck mixer 18.
- Cement slurry: substantially water and cement particles which are suspended in the washout water;
- Settled cement mixtures: primarily the cement components that require several hours to settle out of the cement slurry after the sand and stone mixture settles to the bottom of the bucket 26;
- Clarified water: water which is left is the bucket after several hours of settling and separation of the cement mixture from the cement slurry.

Wash water, both for use in washing out a mixer 18 and discharged therefor has extreme variations of conditions. Two circumstances that lead to these variations include how many trucks 18 have been washed out with substantially the same water, and how "dirty" the inside of each of those mixer drums 18 were. These variations are in most cases, impossible to control; therefore an automated method has been developed for dealing with these variations in a controlled manner without resorting to requirements such as that the variation as be manually identified, tracked, or calculated. Rather the system 10 can efficiently and effectively deal with any type of dirty wash water that in the past was commonly discarded.

The water scan cycle (FIG. 10) commences by reading the weight of the concrete and the providing data signal to the by means of the load cell 55 to the process controller 100. The volume of material contained in the bucket 26 is also determined and is read by ultrasonic sensors 56 and the data signal is provided to the process controller 100 through electrical data signal bus 117 (FIG. 1B). The process controller 100 determines the average density of material in the bucket 26, step 294, from calculations of signal data values derived from step 292 and from step 290.

With the three variables weight, volume, and density, as determined and recorded by steps 290,292,294, the process controller 100 compares the volume of the sand and stone mixture against predetermined ranges of desired values which are stored in the CPU 120 and, which are indicative that excess sand and stone mixture is contained in the slurry mix which may impede sufficient washing out of mixers. If separation of constituents is required, the system 10 is directed to elevate the bucket 26, step 298. An additional feature of the present invention is the variability in the amount of separation which will optimize obtaining cleaner washout water. The controller 100 may be programmed to determine to what degree the bucket 26 should be tilted in order to dump the only cement slurry into hopper 60, step 300. Following the calculation step 300, the controller 100 directs the extension of the dump cylinder 23 to the degree required to obtain the calculated tilt of bucket 26, step 302. The optimal degree of tilt spills out essentially cement slurry into hopper 60 so that as much sand and stone mixture as possible is retained in the bucket 26.

The separation step 302 is followed by dumping step 304 wherein the bucket 26 dumps to the opposite direction and the sand and stone mixture flows into the hopper 60'. It is necessary that the bucket 26 return to the rest position (FIG. 4A) to allow the change in rod engagement from rod 94 to rod 94' and permit a change in dump direction. The sand and stone mixture in hopper 60' is released by the pinched gate 74' through rubber boot 76', rubber boot 76' through the infeed hopper 86 and into the stabilization mixer vessel 82, where any water and chemical that is still mixed with the sand and stone mixture assists in the stabilization process, as described above. Thus, the sand and stone mixture is separated from the cement slurry water.

Bucket 26 is lowered from the top of the tower 30, step 306, and the water is returned from the front hopper 60 to the bucket 26 utilizing the wash water return pipe 108 as described above, step 308. Alternately, a rotatable diversion chute (not shown) may be inserted under hopper 60 to direct the slurry water into bucket 226. At this point, the wash cycle is completed and ready to begin again. In the event that the comparison step 296 provides an indication that no separation is necessary, then the process controller directs no operation as is indicated by step 312.

An identical cycle to the water scan cycle described in FIG. 10 takes place approximately four hours after the last truck mixer 18 has been washed out. At that time, the cement particles have had sufficient time to settle to the bottom of the bucket 26, leaving only clarified water in the top of bucket 26. Steps 290–310 are performed at that time in order to induce the cement slurry mixture into the vessel 82. Addition of the cement solid constituents aids in the strength of the stabilized material and the water and chemical content of the mixture aids in reducing the slump of the stabilized material in the vessel 82 to reduce the amount of fresh chemical that is consumed during the temporary storage period.

Figure 11:
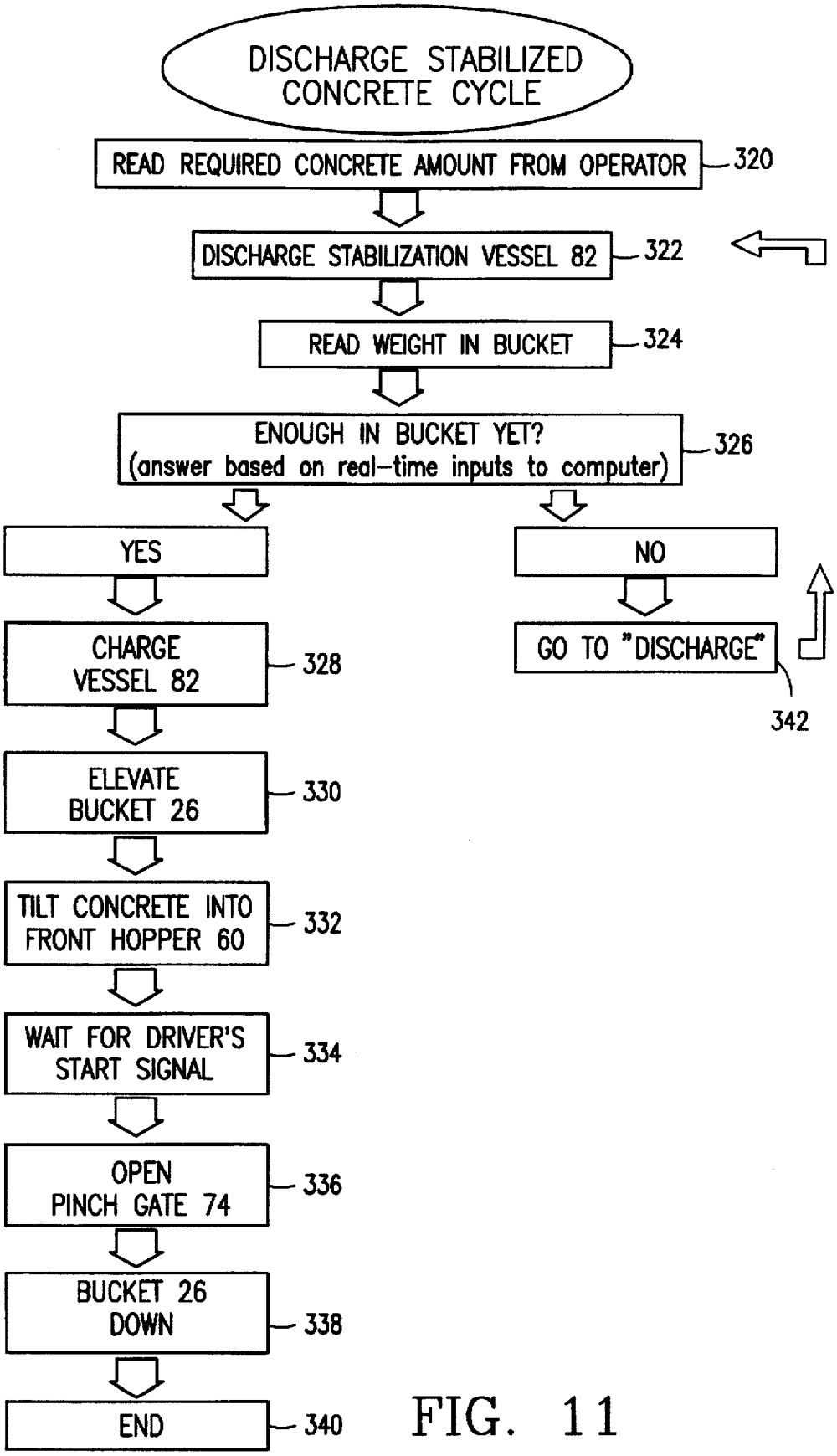
FIG. 11 illustrates a detail flow chart of the concrete discharge cycle of the system which is a feature of the present invention as shown in FIG. 6.

The discharging stabilized concrete cycle, will be described with reference to FIGS. 6 and 11. Upon operator demand, step 320, the system 10 will discharge the desired amount of stabilized concrete, step 322, from the stationary mixer 82 and into a waiting ready-mix truck 16 at the loading dock 12. The discharged concrete exits the holding vessel 82 and flows down the chute 87 into the bucket 26. The weight of the material flowing into the bucket 26 is monitored by the loop of steps 322, 324, 326, 342, back to 322 such that the vessel 82 will continue to discharge concrete until the process controller determines that the predetermined amount of concrete is contained in bucket 26, step 326. The material in the bucket 26 is weighed in step 324 and the process controller 100 compares the value of the desired amount of concrete with the value of the weight in the bucket at the moment of the reading. If the value desired is more than the value of the current weight of the material in the bucket 26, then the vessel 82 continues to discharge concrete into the bucket 26. At moment when the weight of the material in the bucket exceeds the desired weight of material needed for shipment, the stationary mixer 82 reverses rotation and is charged, step 328.

The bucket 26 which contains the stabilized material is elevated in the tower 30, step 330 and is tilted in step 332 such that the entire contents of the bucket 26 are discharged into the front hopper 60. The driver or operator commences loading of truck 16, step 334, by opening the pinch gate 74, step 336. The material contained in hopper 60 is directed by the infeed hopper 22 of the truck 16 into the mixer 18. The empty bucket 26 is lowered, step 338, and the cycle is ended, step 340.

The batch of concrete loaded into truck mixer 18 from the storage mixer 82 may be sufficient to deliver directly to the construction site. However, it has been found preferable to add the stabilized concrete together with a newly mixed concrete mixture, directly into a truck mixer 18. The use of fresh water and other necessary constituents, together with the mixture taken from the storage mixer 82 makes for a better concrete mixture which is more able to meet construction needs. Mixing new and stabilized concrete together has been found to more closely correspond to concrete which is mixed only from fresh constituents. This enables the characteristics of the stabilized concrete to be better known and to permit less diligent monitoring of the stabilized concrete mixture at the construction site.

After the truck mixer 18 is rotated and also loaded with an additional batch of fresh concrete the stabilized and new batch of concrete are mixed together and the concrete is ready for delivery to the job site. In the meantime, after all of the stored concrete is emptied out of the stationary mounted mixer 82, it can be rinsed out and the rinse water may be emptied into the bucket 26, letting the wash water settle for later use in the processing of returning ready mix trucks 16 at the end of the day.

The materials comprising the system 10 according to this invention are commercially available. Preferably, the process controller components are available from Allen-Bradley Company Inc. of Milwaukee, Wis., though other process control equipment may be used. The materials comprising the tower structure 30 are essentially steel, with an appropriate elastomeric rubber material utilized for the boots 76, 76'. The chemical retardant additive comprises sugar or glycerin based compounds which are dissolvable in water. Such a suitable chemical additive is available from Resource Recovery Systems, Inc. of Orland Park, Ill. and is sold under the trade name PROLONG.

The several inventive features described herein give rise to the following desirable effects. Concrete can be safely and effectively reclaimed and stabilized for extended periods of time, thus allowing the complete reuse of all products related to returned concrete without having to use large volumes of water to separate returned concrete into sand, stone, and slurry water. The system 10 also reuses the wash water constituents in the stabilization process, eliminating disposal of those products and constituents, thereby avoiding labor-intensive processing of wash water or conversely, environmental harm. Finally, the system 10 provides ease of operation by automating the difficult and intensive operation required by the system 10 to efficiently and effectively stabilize concrete such that a ready-mix producer can take advantage of the technology.

This closed system for each of the constituents is especially useful to the operation of a concrete mixing plant in jurisdictions which prohibit the discharge of rinse water or other constituents into the sewer system or on the ground due to environmental concerns. Another feature of this system is that no water is wasted, and all of the constituent materials of the concrete are recycled.

An alternative to the single holding vessel 82 demonstrated by the preferred embodiment is a bank of stationary mixers 82 set up in close proximity and the tower structure 30 on a rail system (not shown) to allow movement from one mixer 82 to another of the mixers in the bank.

Use of a stationary mounted mixer assembly 80 is not an absolute necessity for operation of the inventive method. For example, a truck mounted mixer, such as mixer 18, may be utilized to store returned concrete from a number of other trucks for a short period of time, such as overnight. A truck mounted storage system may be more appropriate if the concrete is being stored at the construction site or at a concrete mixing plant in which space is not available for a stationary ground mounted mixer assembly 80. A truck mounted mixer can also be used on occasions when the stationary mixer 82 becomes full because of an unusually large amount of concrete having been returned in a particular day.

In any event, appropriate modifications, such as mounting sensors and connecting control devices of the truck 16 to a processor, such as processor 100 will be necessary to utilize a transportable truck mixer 18. Additionally, provision will have to be made for a transportable tower structure (not shown) and for a portable process controller.

The system 30 can be housed permanently in a ready-mix plant, or portions of it may be mobile for use at various sites. For example, in the case where it is desired to store unused concrete at a construction job site, the material handling system 10 can be made mobile and transported to the construction site. Mobility may be effected by mounting the carriage structure 40 and tower 30 on a flatbed mounted on wheels (not shown) so that the tower 30 may be connected to the rear of a truck through a tandem trailer arrangement.

Some manipulation of the sensor equipment mounted on the ready mix truck may be required, such as providing connections between the sensors and the controller, such as by microwave frequency communications or by other appropriate means. It is contemplated that the unified, portable process controller (not shown) may be mounted for transportation with a portable tower structure or with a transportable mixer truck 18 having appropriate sensors for determining concrete temperature, weight, etc.

Other variations of the preferred system and method will become apparent to a person of ordinary skill in the art once a full understanding of the present invention is had. For example, different elevations can be provided for different elements of the system to reduce lift heights and points of charge and discharge. The size of the material handling bucket 26 and the tower structure 30 may be customized to the end user's requirements. Additionally, a system having different heights for the trucks 16 may permit a reduction in the steps of the operation of the inventive system.

Other modifications will be apparent; for example the water in the holding tank may be reused in making a new batch of concrete the following day so as to fresh water to be injected into the system on a daily basis. Occasional fresh water infusion into the closed system will clean out all of the settling residue and will remove undesirable build up of a constituent, such as cement powder, in the system 10.

The system may also be used in an alternative capacity as a material transfer system. For example, if a mixer truck, such as truck 16, becomes disabled and must discharge its mixed concrete contents, the system 10, or simply the material-handling bucket 26 and tower structure 30, may be utilized to transfer the material from the disabled truck to a truck which is operational.

Other alternative embodiments and variations are possible. Accordingly, the foregoing embodiments are described as being illustrative and not limiting, the scope of the invention being limited only by the following claims.

What is claimed is:

1. An automatic system to reclaim for reuse unused portions of mixed concrete comprising:

a) unloading means for discharging the unused portions of concrete from a movable container;

b) a material handling bucket for receiving the unused portions of concrete from said unloading means;

c) means for elevating and lowering said material handling bucket, said means including automatic controls for activating said elevating and lowering means;

d) means for automatically tilting said material handling bucket and for pouring the concrete contained in said material handling bucket to a temporary settling container, said means including automatic controls for activating said means for automatically tilting said material handling bucket;

e) means for automatically adding a chemical agent to said unused concrete to change the hydration condition of the concrete, said means including automatic controls for activating said means to add the chemical agent to said concrete;

f) at least one storage mixer for receiving the unused concrete from said material handling bucket and for storing the unused concrete, said mixer being capable of revolving;

g) means for revolving said mixer and causing said chemical agent to homogeneously mix with the concrete in said at least one storage mixer, including automatic controls for activating said storage mixer to rotate and mix said concrete in said storage mixer at preselected periods or when predetermined parameters of the concrete conditions have been met;

h) means for discharging the concrete from said storage mixer into said material handling bucket and for loading the concrete into a storage means;

i) a plurality of sensors for monitoring the condition of the concrete in said storage means and in the ambient environment to determine whether said predetermined parameters are met; and j) a process controller in data communication with said automatic controls;

k) means for communication between said sensors and said process controller and between said process controller and said automatic controls to provide signal data to the process controller for monitoring the condition of said concrete and for supplying signal data to said automatic controls to activate at least one of said elements recited in clauses c, d, e, and g, above, to change the condition of said concrete and to bring said condition within said predetermined parameters.

2. The system for reclaiming unused portions of mixed concrete according to claim 1 wherein said elevating means comprises a pulley system powered by a hydraulic lift.

3. The system for reclaiming unused portions of mixed concrete according to claim 2 wherein said hydraulic lift further comprises at least one hydraulic cylinder.

4. The system for reclaiming unused portions of mixed concrete according to claim 2 wherein said hydraulic lift further comprises at least one electrically operated winch.

5. The system for reclaiming unused portions of mixed concrete according to claim 1 wherein said means for automatically tilting said material handling bucket comprises dual acting hydraulic cylinders.

6. The system for reclaiming unused portions of mixed concrete according to claim 1 wherein said storage mixer comprises a stationary mounted mixer.

7. The system for reclaiming unused portions of mixed concrete according to claim 1 wherein said storage mixer comprises a truck mounted mixer.

8. The system for reclaiming unused portions of mixed concrete according to claim 1 wherein said material handling bucket comprises a quadrilateral volume having four side walls and at least two spouts, one each disposed at a first two oppositely disposed side walls of said material handling bucket along the peripheral rim of said bucket for facilitating the discharge of the concrete in oppositely disposed directions, said bucket tilting means comprising two hydraulically controlled cylinders, one each disposed at a second two oppositely disposed side walls of said material handling bucket spaced from said first two side walls.

9. The system for reclaiming unused portions of mixed concrete according to claim 8 wherein said first two side walls of said material handling bucket extend upwardly from the bottom of said bucket at an angle and said second two side walls of said material handling bucket extend vertically upward from the bottom of said bucket.

10. The system for reclaiming unused portions of mixed concrete according to claim 1 wherein said elevating means includes a carriage on which said material handling bucket and said bucket tilting means are disposed and further includes a tower for vertically guiding said carriage along said tower, said material handling bucket being connected to said carriage by said bucket tilting means and being capable of rotational transposition with respect to a horizontal surface of said carriage.

11. The system for reclaiming unused portions of mixed concrete according to claim 10 wherein said means for automatically tilting said material handling bucket comprises a rod disposed adjacent each side wall of said material handling bucket and being connected thereto, and at least one set of automatically actuated locking means disposed on said carriage, each said locking means including at least two cup-shaped rod cradles, one rod cradle engaging an associated rod within a cup-shaped portion of said rod cradle and said locking means locking said rod within said rod cradle, said rods and said rod cradles being aligned, and said rods each defining a pivot axis about which said material handling bucket can tilt and rotate with respect to said carriage when said rod disposed on said opposite angled side wall is released by said associated locking means.

12. The system for reclaiming unused portions of mixed concrete according to claim 1 wherein said chemical agent comprises a combination of elements including sugar derivatives.

13. The system for reclaiming unused portions of mixed concrete according to claim 1 wherein said means for elevating said material handling bucket includes a carriage, and said means for automatically tilting said material han dling bucket comprises a rod disposed adjacent each side wall of said material handling bucket and being connected thereto, and at least one set of automatically actuated locking means disposed on said carriage, each said locking means including at least two cup-shaped rod cradles, one rod cradle engaging an associated rod within a cup-shaped portion of said rod cradle and said locking means locking said rod within said rod cradle, said rods and said rod cradles being aligned, and said rods each defining a pivot axis about which said material handling bucket can tilt and rotate with respect to said carriage when said rod disposed on said opposite angled side wall is released by said associated locking means.

* * * * *